US011694633B2

(12) United States Patent
Lee et al.

(10) Patent No.: US 11,694,633 B2
(45) Date of Patent: Jul. 4, 2023

(54) DISPLAY DEVICE HAVING A SUB PIXEL COLUMN CONNECTED TO DIFFERENT DATA LINES

(71) Applicant: LG Display Co., Ltd., Seoul (KR)

(72) Inventors: MinJic Lee, Paju-si (KR); Yeseul Han, Gimpo-si (KR); JeongOk Jo, Seoul (KR); Kwanghyun Choi, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/458,100

(22) Filed: Aug. 26, 2021

(65) Prior Publication Data

US 2022/0208121 A1 Jun. 30, 2022

(30) Foreign Application Priority Data

Dec. 24, 2020 (KR) ..... 10-2020-0183903

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0452* (2013.01); *G09G 2310/0297* (2013.01)

(58) Field of Classification Search
CPC ..... G09G 3/3291
USPC ..... 345/84
See application file for complete search history.

(56) References Cited

U.S. PATENT DOCUMENTS

2016/0189642 A1* 6/2016 Shin ..... G09G 3/3648 345/88
2017/0141177 A1* 5/2017 Kim ..... H01L 27/3262
2020/0184900 A1* 6/2020 Shin ..... G09G 3/3233

FOREIGN PATENT DOCUMENTS

KR 10-2022-0015292 A 2/2022

* cited by examiner

*Primary Examiner* — Long D Pham
(74) *Attorney, Agent, or Firm* — Fenwick & West LLP

(57) ABSTRACT

The display device includes a display panel where sub-pixels are disposed. The display device includes a data driver that supplies a data voltage to the sub-pixels via data lines. The sub-pixels includes first sub-pixels to third sub-pixels. The first sub-pixels and second sub-pixels are alternately disposed on odd-numbered columns and the third sub-pixels are disposed on even-numbered columns. Each of the data lines branches into sub-data lines through a MUX, and the sub-data lines are disposed on both sides of the sub-pixels disposed on a column. Any one third sub-pixel of the third sub-pixels disposed on a row is connected to a sub-data line disposed on one side of the any one of third sub-pixel. Further, another third sub-pixel adjacent to any one third sub-pixel disposed on the row is connected to a sub-data line disposed on another side of the adjacent third sub-pixel. Thus, line dim is reduced.

13 Claims, 6 Drawing Sheets

DISPLAY DEVICE HAVING A SUB PIXEL COLUMN CONNECTED TO DIFFERENT DATA LINES

CROSS-REFERENCE TO RELATED APPLICATIONS

This application claims the priority of Republic of Korea Patent Application No. 10-2020-0183903 filed on Dec. 24, 2020, in the Korean Intellectual Property Office, the disclosure of which is hereby incorporated by reference in its entirety.

BACKGROUND

Field

The present disclosure relates to a display device, and more particularly, to a display device capable of removing line dim.

Description of the Related Art

Display devices employed by the monitor of a computer, a television (TV), a mobile phone or the like include an organic light emitting display (OLED) that emits light by itself, and a liquid crystal display (LCD) that requires a separate light source.

Among such various display devices, an organic light emitting display device includes a display panel including a plurality of sub-pixels and drivers for driving the display panel. The drivers include a gate driver that supplies a scan signal to the display panel and a data driver that supplies a data voltage. When a signal, such as a gate signal and a data voltage, is supplied to a sub-pixel of the organic light emitting display device, the selected sub-pixel emits light to display an image.

However, due to components disposed under data lines for transmitting a data voltage, charging of a data voltage may be delayed by parasitic capacitances.

Also, due to a change in the components disposed under the data lines, the time of delay in charging of a data voltage is changed. Such a change in the time of delay in charging of a data voltage causes line dim in the display panel.

SUMMARY

An object to be achieved by the present disclosure is to provide a display device capable of reducing line dim.

Another object to be achieved by the present disclosure is to provide a display device which may be driven by a dot inversion driving method.

Objects of the present disclosure are not limited to the above-mentioned objects, and other objects, which are not mentioned above, can be clearly understood by those skilled in the art from the following descriptions.

According to an aspect of the present disclosure, the display device includes a display panel in which a plurality of sub-pixels is repeatedly disposed in a matrix form. The display device further includes a data driver configured to supply a data voltage to the plurality of sub-pixels via a plurality of data lines. The display device also includes a gate driver configured to supply a scan signal to the plurality of sub-pixels via a plurality of scan lines. The plurality of sub-pixels includes first sub-pixels, second sub-pixels and third sub-pixels having different colors each other. The first sub-pixels and the second sub-pixels are alternately disposed on odd-numbered columns and the third sub-pixels are disposed on even-numbered columns. Each of the plurality of data lines branches into a plurality of sub-data lines through a MUX, and the plurality of sub-data lines is disposed on both sides of the plurality of sub-pixels disposed on a column. Any one third sub-pixel of the plurality of third sub-pixels disposed on a row is connected to a sub-data line disposed on one side of the any one of third sub-pixel. Further, another third sub-pixel adjacent to any one third sub-pixel among the plurality of third sub-pixels disposed on the row is connected to a sub-data line disposed on the other side of the adjacent third sub-pixel. Thus, it is possible to remove or at least reduce line dim.

Other detailed matters of the exemplary embodiments are included in the detailed description and the drawings.

According to the present disclosure, even when fast driving is performed, a data voltage can be sufficiently charged during two horizontal periods. Thus, it is possible to achieve an improvement in image quality.

According to the present disclosure, sub-pixels that output a low luminance and sub-pixels that output a high luminance are disposed in the form of a dot. Thus, it is possible to remove line dim in a display panel.

The effects according to the present disclosure are not limited to the contents exemplified above, and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
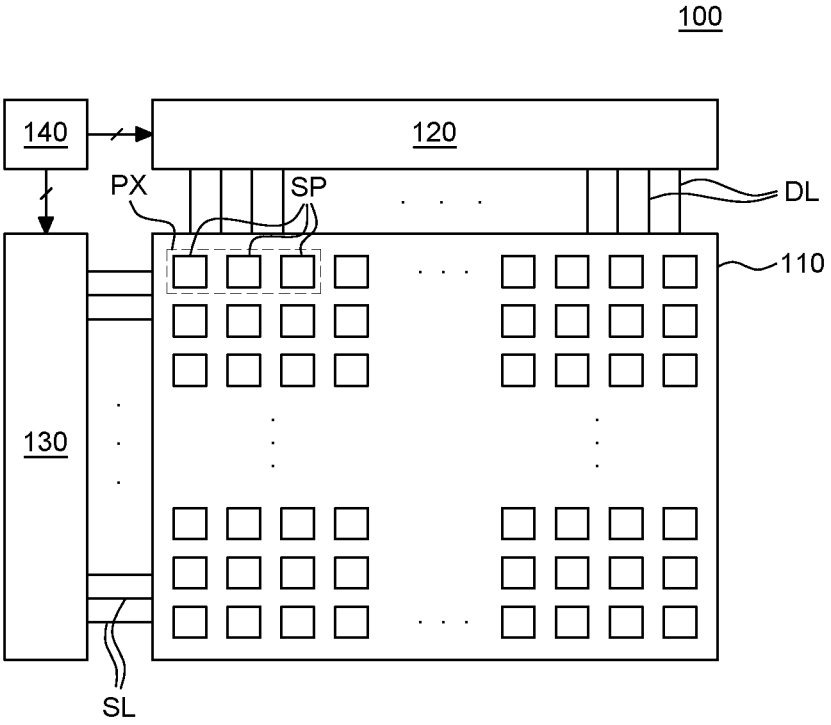
FIG. 1 is a schematic diagram illustrating a display device according to an exemplary embodiment of the present disclosure.

Advantages and characteristics of the present disclosure and a method of achieving the advantages and characteristics will be clear by referring to exemplary embodiments described below in detail together with the accompanying drawings. However, the present disclosure is not limited to the exemplary embodiments disclosed herein but will be implemented in various forms. The exemplary embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "comprising" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is disposed "on" another element or layer, another layer or another element may be interposed directly on the other element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

Transistors used in a display device according to the present disclosure may be implemented by one or more of an n-channel transistor (NMOS) and a p-channel transistor (PMOS). The transistors may be implemented by an oxide semiconductor transistor using an oxide semiconductor as an active layer or an LTPS transistor using low temperature poly-silicon (LTPS) as an active layer. Each transistor may include at least a gate electrode, a source electrode and a drain electrode. The transistors may be implemented as thin film transistors (TFT) on a display panel. In each transistor, carriers flow from the source electrode to the drain electrode. In case of the n-channel transistor (NMOS), because carriers are electrons, a source voltage is lower than a drain voltage so that electrons may flow from a source electrode to a drain electrode. In the NMOS, a current flows from the drain electrode to the source electrode and the source electrode may be an output terminal. In case of the p-channel transistor (PMOS), because carriers are holes, a source voltage is higher than a drain voltage so that holes may flow from a source electrode to a drain electrode. In the PMOS, because holes flow from the source electrode to the drain electrode, a current flows from the source electrode to the drain electrode, and the drain electrode may be an output terminal. Therefore, the source and the drain may be changed depending on an applied voltage, and, thus, it should be noted that the source and the drain of the transistor are not fixed. In the present disclosure, the transistors will be described as being assumed to be n-channel transistors (NMOS), but are not limited thereto. Herein, p-channel transistors (PMOS) may be used, and in this case, a circuit configuration may be changed accordingly.

A scan signal of the transistor used as a switch element swings between a gate-on voltage and a gate-off voltage. The gate-on voltage is set greater than a threshold voltage Vth, and the gate-off voltage is set less than the threshold voltage Vth. The transistor is turned on in response to the gate-on voltage and turned off in response to the gate-off voltage. In case of an NMOS, the gate-on voltage may be a gate high voltage VGH and the gate-off voltage may be a gate low voltage VGL that is less than the gate high voltage VGH. In case of a PMOS, the gate-on voltage may be the gate low voltage VGL and the gate-off voltage may be the gate high voltage VGH.

Hereinafter, various exemplary embodiments of the present disclosure will be described in detail with reference to the accompanying drawings.

FIG. 1 is a schematic diagram illustrating a display device according to an exemplary embodiment of the present disclosure. Referring to FIG. 1, a display device 100 includes a display panel 110, a gate driver 130, a data driver 120 and a timing controller 140.

The display panel 110 is a panel for displaying an image. The display panel 110 may include various circuits, lines and light emitting elements on a substrate. The display panel 110 may include a plurality of pixels PX defined by a plurality of data lines DL and a plurality of scan lines SL that intersect each other. The plurality of pixels PX is connected to the plurality of data lines DL and the plurality of scan lines SL. The display panel 110 may include a display area defined by the plurality of pixels PX and a non-display area in which various signal lines, pads, etc. are formed. The display panel 110 may be implemented as a display panel 110 used in various display devices such as a liquid crystal display device, an organic light emitting display device and an electrophoretic display device. In the following description, the display panel 110 will be described as a panel used in an organic light emitting display device, but is not limited thereto.

The timing controller 140 receives timing signals such as a vertical synchronization signal, a horizontal synchronization signal, a data enable signal and a dot clock via a receiving circuit such as LVDS and TMDS interfaces connected to a host system. The timing controller 140 generates timing enable signals for controlling the data driver 120 and the gate driver 130 based on the received timing signals.

The data driver 120 supplies a data voltage Vdata to a plurality of sub-pixels R, G and B (SP). The data driver 120 may include a plurality of source drive integrated circuits (ICs). The plurality of source drive ICs may receive digital video data and a source timing enable signal from the timing controller 140. The plurality of source drive ICs may convert the digital video data into a gamma voltage in response to the source timing enable signal to generate the data voltage Vdata. Then, the plurality of source drive ICs may supply the data voltage Vdata via the data lines DL of the display panel 110. The plurality of source drive ICs may be connected to the data lines DL of the display panel 110 through a chip-on-glass (COG) process or a tape automated bonding (TAB) process. Further, the source drive ICs may be formed on the display panel 110 or may be formed on a separate PCB and connected to the display panel 110.

The gate driver 130 supplies a scan signal to the plurality of sub-pixels R, G and B (SP). The gate driver 130 may include a level shifter and a shift register. The level shifter may shift the level of a clock signal input at a transistor-transistor-logic (TTL) level from the timing controller 140 and then may supply it to the shift register. The shift register may be formed in the non-display area of the display panel 110 by using a GIP technique, but is not limited thereto. The shift register may include a plurality of stages for shifting scan signals to output them in response to the clock signal and a driving signal. The plurality of stages included in the shift register may sequentially output scan signals via a plurality of output terminals.

The display panel 110 may include the plurality of sub-pixels R, G and B (SP). The plurality of sub-pixels R, G and B (SP) may be sub-pixels SP for emitting light of different colors each other. For example, the plurality of sub-pixels R, G and B (SP) may include a red sub-pixel, a green sub-pixel, a blue sub-pixel and a white sub-pixel, but is not limited thereto. The plurality of sub-pixels R, G and B (SP) may form a pixel PX. That is, a red sub-pixel, a green sub-pixel, a blue sub-pixel and a white sub-pixel may form a single pixel PX, and the display panel 110 may include a plurality of pixels PX.

Hereinafter, a driver circuit for driving a single sub-pixel SP will be described in detail with reference to FIG. 2.

Figure 2:
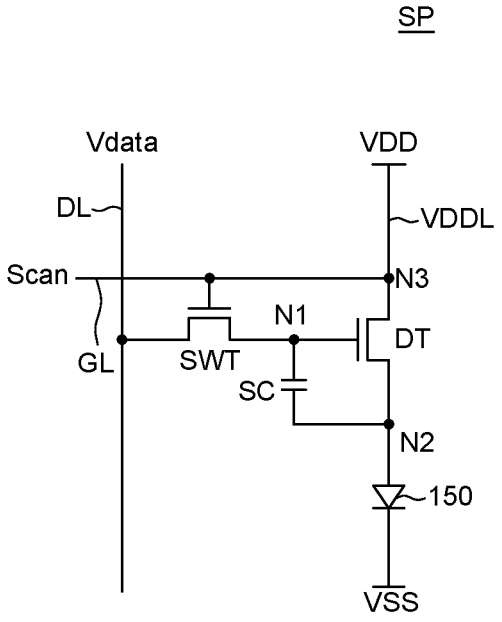
FIG. 2 is a circuit diagram of a sub-pixel in the display device according to an exemplary embodiment of the present disclosure.

FIG. 2 is a circuit diagram of a sub-pixel in the display device according to an exemplary embodiment of the present disclosure. FIG. 2 shows a circuit diagram of one sub-pixel SP of the plurality of sub-pixels R, G and B (SP) of the display device 100.

Referring to FIG. 2, the sub-pixel SP may include a switching transistor SWT, a driving transistor DT, a storage capacitor SC and a light emitting element 150.

The light emitting element 150 may include an anode, an organic layer and a cathode. The organic layer may include various organic layers such as a hole injection layer, a hole transport layer, an organic emission layer, an electron transport layer and an electron injection layer. The anode of the light emitting element 150 may be connected to an output terminal of the driving transistor DT, and a low potential voltage VSS may be applied to the cathode. Although an organic light emitting element 150 is described as the light emitting element 150 in the example shown in FIG. 2, the present disclosure is not limited thereto. An inorganic light emitting diode, (e.g., an LED) may also be used as the light emitting element 150.

Referring to FIG. 2, the switching transistor SWT is a transistor for transferring the data voltage Vdata to a first node N1 corresponding to a gate electrode of the driving transistor DT. The switching transistor SWT may include a drain electrode connected to a data line DL, a gate electrode connected to a scan line SL, and a source electrode connected to the gate electrode of the driving transistor DT. The switching transistor SWT may be turned on by a scan voltage Scan applied from the scan line SL to transfer the data voltage Vdata supplied from the data line DL to the first node N1 corresponding to the gate electrode of the driving transistor DT.

Referring to FIG. 2, the driving transistor DT is a transistor for driving the light emitting element 150 by supplying a driving current to the light emitting element 150. The driving transistor DT may include the gate electrode corresponding to the first node N1 and a source electrode corresponding to the second node N2 and serving as an output terminal. Also, the driving transistor DT may include a drain electrode corresponding to a third node N3 and serving as an input terminal. The gate electrode of the driving transistor DT may be connected to the switching transistor SWT and the drain electrode may receive a high-potential voltage VDD through a high-potential voltage line VDDL. Further, the source electrode may be connected to the anode of the light emitting element 150.

Referring to FIG. 2, the storage capacitor SC is a capacitor for holding a voltage equal to the data voltage Vdata for one frame. One electrode of the storage capacitor SC may be connected to the first node N1, and the other electrode of the storage capacitor SC may be connected to the second node N2.

Meanwhile, as the driving time of each sub-pixel SP in the display device 100 increases, a circuit element, such as the driving transistor DT, may be degraded. As a result, characteristic values of the circuit element, such as the driving transistor DT, may be changed. The characteristic values of the circuit element may include a threshold voltage Vth of the driving transistor DT, a mobility a of the driving transistor DT, etc. Such change in the characteristic values of the circuit element may cause a change in the luminance of the sub-pixel SP. Therefore, a change in the characteristic values of the circuit element may be regarded as a change in the luminance of the sub-pixel SP.

Further, the degree of the change in characteristic values of the circuit elements between the sub-pixels SP may be different depending on the degree of degradation of the circuit elements. Such a difference in the degree of change in the characteristic values between the circuit elements may cause a deviation in the luminance between the sub-pixels SP. Therefore, a deviation in the characteristic values of the circuit elements may be regarded as a deviation in the luminance of the sub-pixels SP. A change in the characteristic values of the circuit element (e.g., a change in the luminance of the sub-pixel SP), and a deviation in the characteristic values between the circuit elements (e.g., a deviation in the luminance between the sub-pixels SP) may lower the accuracy in the luminance represented by the sub-pixels SP or may generate defects on an image.

Thus, the sub-pixel SP of the display device 100 according to an exemplary embodiment of the present disclosure may provide a function of sensing the characteristic values of the sub-pixel SP and a function of compensating for the characteristic values of the sub-pixel SP based on the results of the sensing.

Therefore, the sub-pixel SP may further include a sensing transistor for effectively controlling a voltage state at the source electrode of the driving transistor DT, in addition to the switching transistor SWT, the driving transistor DT, the storage capacitor SC and the light emitting element 150.

Hereinafter, a placement relationship of a plurality of sub-pixels R, G and B will be described with reference to FIG. 3.

Figure 3:
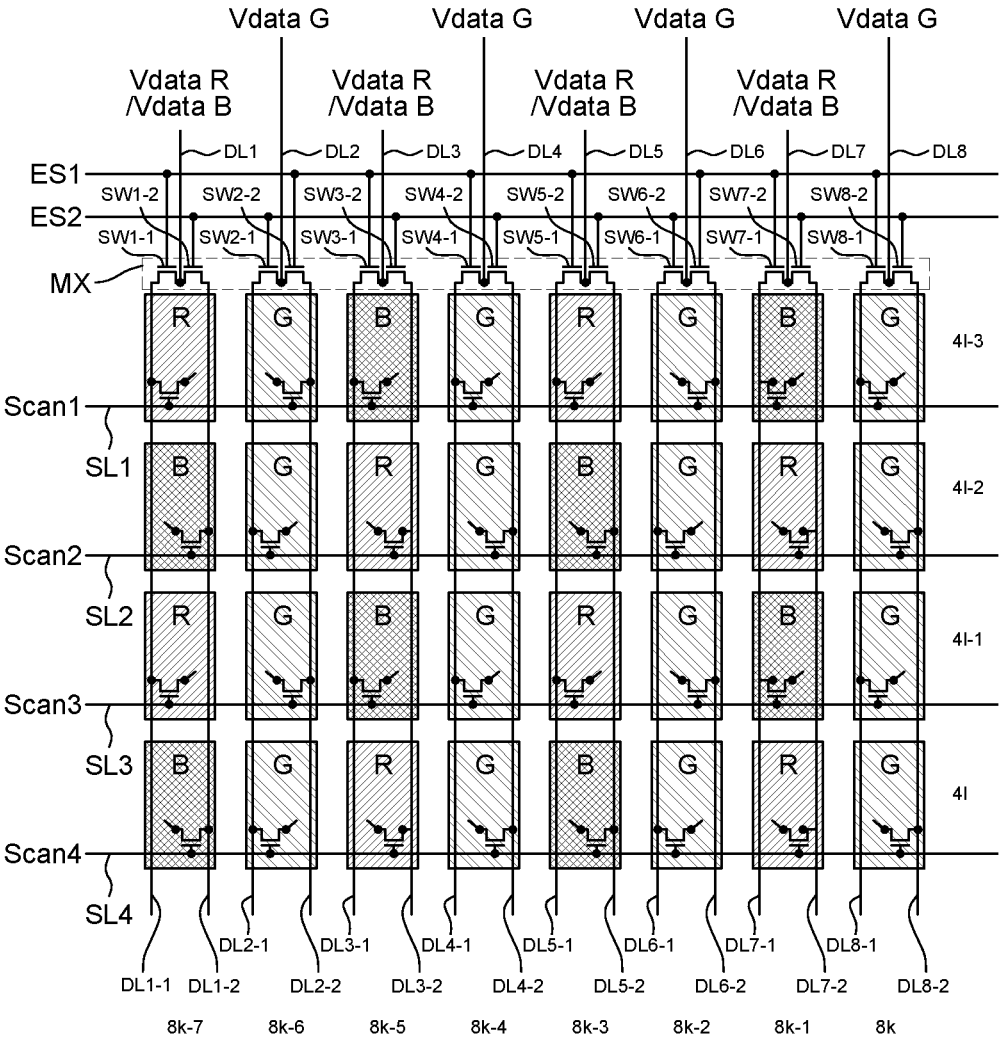
FIG. 3 is a block diagram for explaining a placement relationship of sub-pixels in the display device according to an exemplary embodiment of the present disclosure.

FIG. 3 is a block diagram for explaining a placement relationship of sub-pixels in the display device according to an exemplary embodiment of the present disclosure.

For the convenience of description, FIG. 3 illustrates only 32 sub-pixels R, G and B disposed in an 8×4 matrix formed on a (4l-3)th row to a 4lth row and on a (8k-7)th column to an 8kth column. In the display area, the placement relationship of 32 sub-pixels R, G and B disposed in an 8×4 matrix form is repeated. Further, transistors disposed between the sub-pixels R, G and B and the data lines DL1 to DL8 are the switching transistors SWT described above with reference to FIG. 2 (herein, each of l and k is a natural number of 1 or more).

Referring to FIG. 3, each pixel PX includes three sub-pixels R, G and B. For example, each pixel PX may include a first sub-pixel R, a second sub-pixel B and a third sub-pixel G as shown in FIG. 3. Also, the first sub-pixel R may be a red sub-pixel, the second sub-pixel B may be a blue sub-pixel and the third sub-pixel G may be a green sub-pixel. However, the present disclosure is not limited thereto. The plurality of sub-pixels R, G and B may be changed to various color sub-pixels (magenta, yellow and cyan sub-pixels).

Further, the first sub-pixels R and the second sub-pixels B may be alternately disposed on odd-numbered columns and only the third sub-pixels G may be disposed on even-numbered columns.

As shown in FIG. 3, the first sub-pixels R and the second sub-pixels B may be alternately disposed on each of the (8k-7)th column, a (8k-5)th column, a (8k-3)th column and a (8k-1)th column. Only the third sub-pixels G may be disposed on each of a (8k-6)th column, a (8k-4)th column, a (8k-2)th column and the 8kth column.

Specifically, on each of the (8k-7)th column and the (8k-3)th column, the first sub-pixels R are disposed on the (4l-3)th row and a (4l-1)th row, and the second sub-pixels B are disposed on a (4l-2)th row and the 4lth row. Further, on each of the (8k-5)th column and the (8k-1)th column, the second sub-pixels B are disposed on the (4l-3)th row and the (4l-1)th row, and the first sub-pixels R are disposed on the (4l-2)th row and the 4lth row.

Further, a first scan line SL1 is connected to a plurality of sub-pixels R, G and B disposed on the (4l-3)th row and supplies a first scan voltage Scan1 to the plurality of sub-pixels R, G and B disposed on the (4l-3)th row. Also, a second scan line SL2 is connected to a plurality of sub-pixels R, G and B disposed on the (4l-2)th row and supplies a second scan voltage Scan2 to the plurality of sub-pixels R, G and B disposed on the (4l-2)th row. Further, a third scan line SL3 is connected to a plurality of sub-pixels R, G and B disposed on the (4l-1)th row and supplies a third scan voltage Scan3 to the plurality of sub-pixels R, G and B disposed on the (4l-1)th row. Furthermore, a fourth scan line SL4 is connected to a plurality of sub-pixels R, G and B disposed on the 4lth row and supplies a fourth scan voltage Scan4 to the plurality of sub-pixels R, G and B disposed on the 4lth row.

Also, a red data voltage Vdata R and a blue data voltage Vdata B may be sequentially applied to odd-numbered data lines (e.g., a first data line DL1), a third data line DL3, a fifth data line DL5 and a seventh data line DL7.

Specifically, the first data line DL1 applies the red data voltage Vdata R to the first sub-pixels R disposed on the (8k-7)th column and the blue data voltage Vdata B to the second sub-pixels B disposed on the (8k-7)th column. Further, the third data line DL3 applies the red data voltage Vdata R to the first sub-pixels R disposed on the (8k-5)th column and the blue data voltage Vdata B to the second sub-pixels B disposed on the (8k-5)th column. Furthermore, the fifth data line DL5 applies the red data voltage Vdata R to the first sub-pixels R disposed on the (8k-3)th column and the blue data voltage Vdata B to the second sub-pixels B disposed on the (8k-3)th column. Moreover, the seventh data line DL7 applies the red data voltage Vdata R to the first sub-pixels R disposed on the (8k-1)th column and the blue data voltage Vdata B to the second sub-pixels B disposed on the (8k-1)th column.

Also, a green data voltage Vdata G may be sequentially applied to even-numbered data lines (e.g., a second data line DL2), a fourth data line DL4, a sixth data line DL6 and an eighth data line DL8.

Specifically, the second data line DL2 applies the green data voltage Vdata G to the third sub-pixels G disposed on the (8k-6)th column. Also, the fourth data line DL4 applies the green data voltage Vdata G to the third sub-pixels G disposed on the (8k-4)th column. Further, the sixth data line DL6 applies the green data voltage Vdata G to the third sub-pixels G disposed on the (8k-2)th column. Furthermore, the eighth data line DL8 applies the green data voltage Vdata G to the third sub-pixels G disposed on the 8kth column.

Further, each of the plurality of data lines DL1 to DL8 may branch into a plurality of sub-data lines DL1-1 to DL8-2 through a MUX.

Specifically, the first data line DL1 may branch into a (1-1)th sub-data line DL1-1 and a (1-2)th sub-data line DL1-2. The above-described (1-1)th sub-data line DL1-1 is disposed on one side of the plurality of sub-pixels R and B disposed on the (8k-7)th column. The above-described (1-2)th sub-data line DL1-2 is disposed on the other side of the plurality of sub-pixels R and B disposed on the (8k-7)th column.

Also, the second data line DL2 may branch into a (2-1)th sub-data line DL2-1 and a (2-2)th sub-data line DL2-2. The above-described (2-1)th sub-data line DL2-1 is disposed on one side of the plurality of sub-pixels G disposed on the (8k-6)th column. The above-described (2-2)th sub-data line DL2-2 is disposed on the other side of the plurality of sub-pixels G disposed on the (8k-6)th column.

Further, the third data line DL3 may branch into a (3-1)th sub-data line DL3-1 and a (3-2)th sub-data line DL3-2. The above-described (3-1)th sub-data line DL3-1 is disposed on one side of the plurality of sub-pixels R and B disposed on the (8k-5)th column. The above-described (3-2)th sub-data line DL3-2 is disposed on the other side of the plurality of sub-pixels R and B disposed on the (8k-5)th column.

Furthermore, the fourth data line DL4 may branch into a (4-1)th sub-data line DL4-1 and a (4-2)th sub-data line DL4-2. The above-described (4-1)th sub-data line DL4-1 is disposed on one side of the plurality of sub-pixels G disposed on the (8k-4)th column. The above-described (4-2)th sub-data line DL4-2 is disposed on the other side of the plurality of sub-pixels G disposed on the (8k-4)th column.

Moreover, the fifth data line DL5 may branch into a (5-1)th sub-data line DL5-1 and a (5-2)th sub-data line DL5-2. The above-described (5-1)th sub-data line DL5-1 is disposed on one side of the plurality of sub-pixels R and B disposed on the (8k-3)th column. The above-described (5-2)th sub-data line DL5-2 is disposed on the other side of the plurality of sub-pixels R and B disposed on the (8k-3)th column.

Also, the sixth data line DL6 may branch into a (6-1)th sub-data line DL6-1 and a (6-2)th sub-data line DL6-2. The above-described (6-1)th sub-data line DL6-1 is disposed on one side of the plurality of sub-pixels G disposed on the (8k-2)th column. The above-described (6-2)th sub-data line DL6-2 is disposed on the other side of the plurality of sub-pixels G disposed on the (8k-2)th column.

The seventh data line DL7 may branch into a (7-1)th sub-data line DL7-1 and a (7-2)th sub-data line DL7-2. The above-described (7-1)th sub-data line DL7-1 is disposed on one side of the plurality of sub-pixels R and B disposed on the (8k-1)th column. The above-described (7-2)th sub-data line DL7-2 is disposed on the other side of the plurality of sub-pixels R and B disposed on the (8k-1)th column.

Further, the eighth data line DL8 may branch into a (8-1)th sub-data line DL8-1 and a (8-2)th sub-data line DL8-2. The above-described (8-1)th sub-data line DL8-1 is disposed on one side of the plurality of sub-pixels G disposed on the 8kth column. The above-described (8-2)th sub-data line DL8-2 is disposed on the other side of the plurality of sub-pixels G disposed on the 8kth column.

Also, the (1-1)th sub-data line DL1-1 is connected to the first sub-pixels R disposed on the (8k-7)th column. That is, the (1-1)th sub-data line DL1-1 is connected to the first sub-pixel R disposed on the (4l-3)th row and the (8k-7)th column and the first sub-pixel R disposed on the (4l-1)th row and the (8k-7)th column.

Further, the (1-2)th sub-data line DL1-2 is connected to the second sub-pixels B disposed on the (8k-7)th column. That is, the (1-2)th sub-data line DL1-2 is connected to the second sub-pixel B disposed on the (4l-2)th row and the (8k-7)th column and the second sub-pixel B disposed on the 4lth row and the (8k-7)th column.

Furthermore, the (2-1)th sub-data line DL2-1 and the (2-2)th sub-data line DL2-2 are connected to the third sub-pixels G disposed on the (8k-6)th column. That is, the (2-1)th sub-data line DL2-1 is connected to the third sub-pixel G disposed on the (4l-2)th row and the (8k-6)th column and the third sub-pixel G disposed on the 4lth row and the (8k-6)th column. Also, the (2-2)th sub-data line DL2-2 is connected to the third sub-pixel G disposed on the (4l-3)th row and the (8k-6)th column and the third sub-pixel G disposed on the (4l-1)th row and the (8k-6)th column.

Moreover, the (3-1)th sub-data line DL3-1 is connected to the second sub-pixels B disposed on the (8k-5)th column. That is, the (3-1)th sub-data line DL3-1 is connected to the second sub-pixel B disposed on the (4l-3)th row and the (8k-5)th column and the second sub-pixel B disposed on the (4l-1)th row and the (8k-5)th column.

Further, the (3-2)th sub-data line DL3-2 is connected to the first sub-pixels R disposed on the (8k-5)th column. That is, the (3-2)th sub-data line DL3-2 is connected to the first sub-pixel R disposed on the (4l-2)th row and the (8k-5)th column and the first sub-pixel R disposed on the 4lth row and the (8k-5)th column.

Furthermore, the (4-1)th sub-data line DL4-1 and the (4-2)th sub-data line DL4-2 are connected to the third sub-pixels G disposed on the (8k-4)th column. That is, the (4-1)th sub-data line DL4-1 is connected to the third sub-pixel G disposed on the (4l-3)th row and the (8k-4)th column and the third sub-pixel G disposed on the (4l-1)th row and the (8k-4)th column. Also, the (4-2)th sub-data line DL4-2 is connected to the third sub-pixel G disposed on the (4l-2)th row and the (8k-4)th column and the third sub-pixel G disposed on the 4lth row and the (8k-4)th column.

Moreover, the (5-1)th sub-data line DL5-1 is connected to the first sub-pixels R disposed on the (8k-3)th column. That is, the (5-1)th sub-data line DL5-1 is connected to the first sub-pixel R disposed on the (4l-3)th row and the (8k-3)th column and the first sub-pixel R disposed on the (4l-1)th row and the (8k-3)th column.

Also, the (5-2)th sub-data line DL5-2 is connected to the second sub-pixels B disposed on the (8k-3)th column. That is, the (5-2)th sub-data line DL5-2 is connected to the second sub-pixel B disposed on the (4l-2)th row and the (8k-3)th column and the second sub-pixel B disposed on the 4lth row and the (8k-3)th column.

Furthermore, the (6-1)th sub-data line DL6-1 and the (6-2)th sub-data line DL6-2 are connected to the third sub-pixels G disposed on the (8k-2)th column. That is, the (6-1)th sub-data line DL6-1 is connected to the third sub-pixel G disposed on the (4l-2)th row and the (8k-2)th column and the third sub-pixel G disposed on the 4lth row and the (8k-2)th column. Also, the (6-2)th sub-data line DL6-2 is connected to the third sub-pixel G disposed on the (4l-3)th row and the (8k-2)th column and the third sub-pixel G disposed on the (4l-1)th row and the (8k-2)th column.

Furthermore, the (7-1)th sub-data line DL7-1 is connected to the second sub-pixels B disposed on the (8k-1)th column That is, the (7-1)th sub-data line DL7-1 is connected to the second sub-pixel B disposed on the (4l-3)th row and the (8k-1)th column and the second sub-pixel B disposed on the (4l-1)th row and the (8k-1)th column.

Moreover, the (7-2)th sub-data line DL7-2 is connected to the first sub-pixels R disposed on the (8k-1)th column. That is, the (7-2)th sub-data line DL7-2 is connected to the first sub-pixel R disposed on the (4l-2)th row and the (8k-1)th column and the first sub-pixel R disposed on the 4lth row and the (8k-1)th column.

Also, the (8-1)th sub-data line DL8-1 and the (8-2)th sub-data line DL8-2 are connected to the third sub-pixels G disposed on the 8kth column That is, the (8-1)th sub-data line DL8-1 is connected to the third sub-pixel G disposed on the (4l-3)th row and the 8kth column and the third sub-pixel G disposed on the (4l-1)th row and the 8kth column. Further, the (8-2)th sub-data line DL8-2 is connected to the third sub-pixel G disposed on the (4l-2)th row and the 8kth column and the third sub-pixel G disposed on the 4lth row and the 8kth column.

MUXs MX are disposed between the plurality of data lines DL1 to DL8 and the plurality of sub-data lines DL1-1 to DL8-2. Further, the MUXs MX are connected to the plurality of data lines DL1 to DL8 and the plurality of sub-data lines DL1-1 to DL8-2 and determine a connection relationship between the plurality of data lines DL1 to DL8 and the plurality of sub-data lines DL1-1 to DL8-2.

The MUXs MX include a plurality of switching elements SW1-1 to SW8-2. Each of the plurality of switching elements SW1-1 to SW8-2 connects each of the plurality of data lines DL1 to DL8 to any one of the plurality of sub-data lines DL1-1 to DL8-2 branching from each of the plurality of data lines DL1 to DL8 depending on a first enable signal ES1 and a second enable signal ES2.

That is, the MUXs MX include a (1-1)th switching element SW1-1 and a (1-2)th switching element SW1-2 connected to the first data line DL1 and a (2-1)th switching element SW2-1 and a (2-2)th switching element SW2-2 connected to the second data line DL2. Also, the MUXs MX include a (3-1)th switching element SW3-1 and a (3-2)th switching element SW3-2 connected to the third data line DL3 and a (4-1)th switching element SW4-1 and a (4-2)th switching element SW4-2 connected to the fourth data line DL4. Further, the MUXs MX include a (5-1)th switching element SW5-1 and a (5-2)th switching element SW5-2 connected to the fifth data line DL5 and a (6-1)th switching element SW6-1 and a (6-2)th switching element SW6-2 connected to the sixth data line DL6. Furthermore, the MUXs MX include a (7-1)th switching element SW7-1 and a (7-2)th switching element SW7-2 connected to the seventh data line DL7 and a (8-1)th switching element SW8-1 and a (8-2)th switching element SW8-2 connected to the eighth data line DL8.

Specifically, the (1-1)th switching element SW1-1 includes a gate electrode to which the first enable signal ES1 is applied and a drain electrode connected to the first data line DL1. Also, the (1-1)th switching element SW1-1 includes a source electrode connected to the (1-1)th sub-data line DL1-1. Thus, when the first enable signal ES1 has a low level, the (1-1)th switching element SW1-1 is turned on and the first data line DL1 and the (1-1)th sub-data line DL1-1 are electrically connected to each other.

The (1-2)th switching element SW1-2 includes a gate electrode to which the second enable signal ES2 is applied and a drain electrode connected to the first data line DL1. Also, the (1-2)th switching element SW1-2 includes a source electrode connected to the (1-2)th sub-data line DL1-2. Thus, when the second enable signal ES2 has a low level, the (1-2)th switching element SW1-2 is turned on and the first data line DL1 and the (1-2)th sub-data line DL1-2 are electrically connected to each other.

Further, the (2-1)th switching element SW2-1 includes a gate electrode to which the second enable signal ES2 is applied and a drain electrode connected to the second data line DL2. Also, the (2-1)th switching element SW2-1 includes a source electrode connected to the (2-1)th sub-data line DL2-1. Thus, when the second enable signal ES2 has a low level, the (2-1)th switching element SW2-1 is turned on and the second data line DL2 and the (2-1)th sub-data line DL2-1 are electrically connected to each other.

The (2-2)th switching element SW2-2 includes a gate electrode to which the first enable signal ES1 is applied and a drain electrode connected to the second data line DL2. Also, the (2-2)th switching element SW2-2 includes a source electrode connected to the (2-2)th sub-data line DL2-2. Thus, when the first enable signal ES1 has a low level, the (2-2)th switching element SW2-2 is turned on and the second data line DL2 and the (2-2)th sub-data line DL2-2 are electrically connected to each other.

Further, the (3-1)th switching element SW3-1 includes a gate electrode to which the first enable signal ES1 is applied and a drain electrode connected to the third data line DL3. Also, the (3-1)th switching element SW3-1 includes a source electrode connected to the (3-1)th sub-data line DL3-1. Thus, when the first enable signal ES1 has a low level, the (3-1)th switching element SW3-1 is turned on and the third data line DL3 and the (3-1)th sub-data line DL3-1 are electrically connected to each other.

The (3-2)th switching element SW3-2 includes a gate electrode to which the second enable signal ES2 is applied and a drain electrode connected to the third data line DL3. Also, the (3-2)th switching element SW3-2 includes a source electrode connected to the (3-2)th sub-data line DL3-2. Thus, when the second enable signal ES2 has a low level, the (3-2)th switching element SW3-2 is turned on and the third data line DL3 and the (3-2)th sub-data line DL3-2 are electrically connected to each other.

Further, the (4-1)th switching element SW4-1 includes a gate electrode to which the first enable signal ES1 is applied and a drain electrode connected the fourth data line DL4. Also, the (4-1)th switching element SW4-1 includes a source electrode connected to the (4-1)th sub-data line DL4-1. Thus, when the first enable signal ES1 has a low level, the (4-1)th switching element SW4-1 is turned on and the fourth data line DL4 and the (4-1)th sub-data line DL4-1 are electrically connected to each other.

The (4-2)th switching element SW4-2 includes a gate electrode to which the second enable signal ES2 is applied and a drain electrode connected the fourth data line DL4. Also, the (4-2)th switching element SW4-2 includes a source electrode connected to the (4-2)th sub-data line DL4-2. Thus, when the second enable signal ES2 has a low level, the (4-2)th switching element SW4-2 is turned on and the fourth data line DL4 and the (4-2)th sub-data line DL4-2 are electrically connected to each other.

Further, the (5-1)th switching element SW5-1 includes a gate electrode to which the first enable signal ES1 is applied and a drain electrode connected the fifth data line DL5. Also, the (5-1)th switching element SW5-1 includes a source electrode connected to the (5-1)th sub-data line DL5-1. Thus, when the first enable signal ES1 has a low level, the (5-1)th switching element SW5-1 is turned on and the fifth data line DL5 and the (5-1)th sub-data line DL5-1 are electrically connected to each other.

The (5-2)th switching element SW5-2 includes a gate electrode to which the second enable signal ES2 is applied and a drain electrode connected to the fifth data line DL5. Also, the (5-2)th switching element SW5-2 includes a source electrode connected to the (5-2)th sub-data line DL5-2. Thus, when the second enable signal ES2 has a low level, the (5-2)th switching element SW5-2 is turned on and the fifth data line DL5 and the (5-2)th sub-data line DL5-2 are electrically connected to each other.

Further, the (6-1)th switching element SW6-1 includes a gate electrode to which the second enable signal ES2 is applied and a drain electrode connected to the sixth data line DL6. Also, the (6-1)th switching element SW6-1 includes a source electrode connected to the (6-1)th sub-data line DL6-1. Thus, when the second enable signal ES2 has a low level, the (6-1)th switching element SW6-1 is turned on and the sixth data line DL6 and the (6-1)th sub-data line DL6-1 are electrically connected to each other.

The (6-2)th switching element SW6-2 includes a gate electrode to which the first enable signal ES1 is applied and a drain electrode connected to the sixth data line DL6. Also, the (6-2)th switching element SW6-2 includes a source electrode connected to the (6-2)th sub-data line DL6-2. Thus, when the first enable signal ES1 has a low level, the (6-2)th switching element SW6-2 is turned on and the sixth data line DL6 and the (6-2)th sub-data line DL6-2 are electrically connected to each other.

Further, the (7-1)th switching element SW7-1 includes a gate electrode to which the first enable signal ES1 is applied and a drain electrode connected to the seventh data line DL7. Also, the (7-1)th switching element SW7-1 includes a source electrode connected to the (7-1)th sub-data line DL7-1. Thus, when the first enable signal ES1 has a low level, the (7-1)th switching element SW7-1 is turned on and the seventh data line DL7 and the (7-1)th sub-data line DL7-1 are electrically connected to each other.

The (7-2)th switching element SW7-2 includes a gate electrode to which the second enable signal ES2 is applied and a drain electrode connected to the seventh data line DL7. Also, the (7-2)th switching element SW7-2 includes a source electrode connected to the (7-2)th sub-data line DL7-2. Thus, when the second enable signal ES2 has a low level, the (7-2)th switching element SW7-2 is turned on and the seventh data line DL7 and the (7-2)th sub-data line DL7-2 are electrically connected to each other.

Further, the (8-1)th switching element SW8-1 includes a gate electrode to which the first enable signal ES1 is applied and a drain electrode connected to the eighth data line DL8. Also, the (8-1)th switching element SW8-1 includes a source electrode connected to the (8-1)th sub-data line DL8-1. Thus, when the first enable signal ES1 has a low level, the (8-1)th switching element SW8-1 is turned on and the eighth data line DL8 and the (8-1)th sub-data line DL8-1 are electrically connected to each other.

The (8-2)th switching element SW8-2 includes a gate electrode to which the second enable signal ES2 is applied and a drain electrode connected to the eighth data line DL8. Also, the (8-2)th switching element SW8-2 includes a source electrode connected to the (8-2)th sub-data line DL8-2. Thus, when the second enable signal ES2 has a low level, the (8-2)th switching element SW8-2 is turned on and the eighth data line DL8 and the (8-2)th sub-data line DL8-2 are electrically connected to each other.

Hereinafter, a method for driving the display device according to an exemplary embodiment of the present disclosure will be described with reference to FIG. 4.

Figure 4:
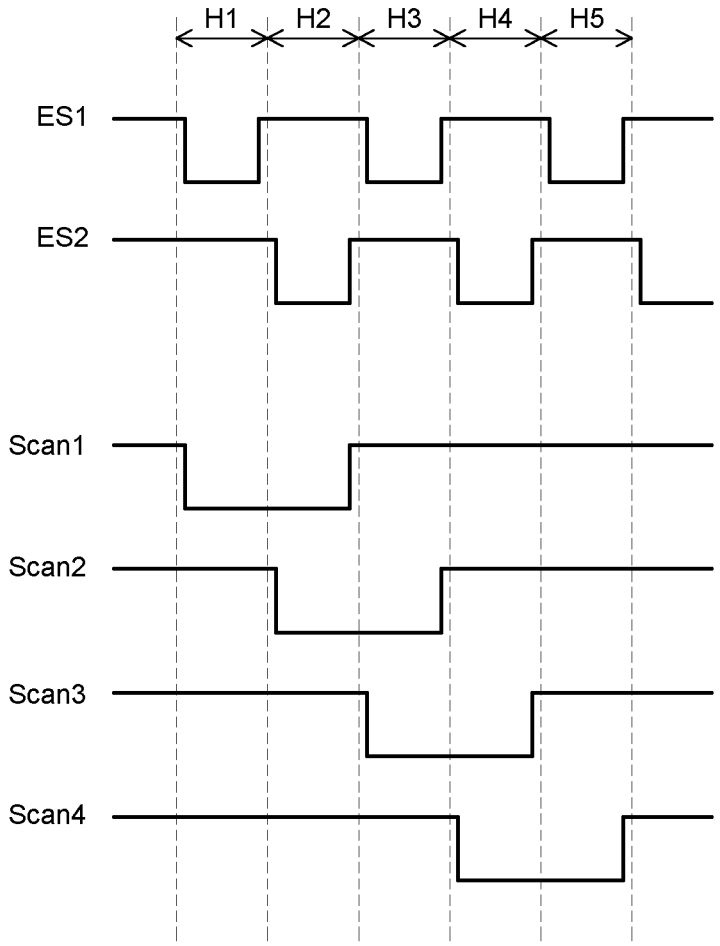
FIG. 4 is a timing chart of enable signals and scan voltages of the display device according to an exemplary embodiment of the present disclosure.

FIG. 4 is a timing chart of enable signals and scan voltages of the display device according to an exemplary embodiment of the present disclosure.

As shown in FIG. 4, the first enable signal ES1 is a square wave inverted every horizontal period. Also, the second enable signal ES2 is a square wave whose phase is inverted with respect to the first enable signal ES1 and which is inverted every horizontal period.

That is, in each of a first horizontal period H1, a third horizontal period H3 and a fifth horizontal period H5, the first enable signal ES1 has a low level which is a turn-on level and the second enable signal ES2 has a high level which is a turn-off level. Also, in each of a second horizontal period H2 and a fourth horizontal period H4, the first enable signal ES1 has the high level which is the turn-off level and the first enable signal ES1 has the low level which is the turn-on level.

Further, the first to fourth scan voltages Scan1 to Scan4 may be sequentially output at the low level which is the turn-on level during two horizontal periods.

That is, the first scan voltage Scan1 is output at the low level which is the turn-on level in the first horizontal period H1 and the second horizontal period H2. Also, the second scan voltage Scan2 is output at the low level which is the turn-on level in the second horizontal period H2 and the third horizontal period H3. Further, the third scan voltage Scan3 is output at the low level which is the turn-on level in the third horizontal period H3 and the fourth horizontal period H4. Furthermore, the fourth scan voltage Scan4 is output at the low level which is the turn-on level in the fourth horizontal period H4 and the fifth horizontal period H5.

As shown in FIG. 4, in the first horizontal period H1, the first scan voltage Scan1 has the low level which is the turn-on level and the first enable signal ES1 has the low level which is the turn-on level.

Thus, during the first horizontal period H1, the switching transistors of the plurality of sub-pixels R, G and B disposed on the (4l-3)th row are turned on. Also, the (1-1)th switching element SW1-1, the (2-2)th switching element SW2-2, the (3-1)th switching element SW3-1, the (4-1)th switching element SW4-1, the (5-1)th switching element SW5-1, the (6-2)th switching element SW6-2, the (7-1)th switching element SW7-1 and the (8-1)th switching element SW8-1 of the MUXs are turned on.

Therefore, during the first horizontal period H1, a data voltage is applied to the plurality of sub-pixels R, G and B disposed on the (4l-3)th row.

That is, during the first horizontal period H1, the red data voltage Vdata R is applied through the (1-1)th sub-data line DL1-1 to the first sub-pixel R disposed on the (4l-3)th row and the (8k-7)th column. Also, the green data voltage Vdata G is applied through the (2-2)th sub-data line DL2-2 to the third sub-pixel G disposed on the (4l-3)th row and the (8k-6)th column. Further, the blue data voltage Vdata B is applied through the (3-1)th sub-data line DL3-1 to the second sub-pixel B disposed on the (4l-3)th row and the (8k-5)th column. Furthermore, the green data voltage Vdata G is applied through the (4-1)th sub-data line DL4-1 to the third sub-pixel G disposed on the (4l-3)th row and the (8k-4)th column. Moreover, the red data voltage Vdata R is applied through the (5-1)th sub-data line DL5-1 to the first sub-pixel R disposed on the (4l-3)th row and the (8k-3)th column. Also, the green data voltage Vdata G is applied through the (6-2)th sub-data line DL6-2 to the third sub-pixel G disposed on the (4l-3)th row and the (8k-2)th column. Further, the blue data voltage Vdata B is applied through the (7-1)th sub-data line DL7-1 to the second sub-pixel B disposed on the (4l-3)th row and the (8k-1)th column. Furthermore, the green data voltage Vdata G is applied through the (8-1)th sub-data line DL8-1 to the third sub-pixel G disposed on the (4l-3)th row and the 8kth column.

Then, in the second horizontal period H2, the first scan voltage Scan1 and the second scan voltage Scan2 have the low level which is the turn-on level and the second enable signal ES2 has the low level which is the turn-on level.

Thus, during the second horizontal period H2, the switching transistors of the plurality of sub-pixels R, G and B disposed on the (4l-3)th row and the (4l-2)th row are turned on. Also, the (1-2)th switching element SW1-2, the (2-1)th switching element SW2-1, the (3-2)th switching element SW3-2, the (4-2)th switching element SW4-2, the (5-2)th switching element SW5-2, the (6-1)th switching element SW6-1, the (7-2)th switching element SW7-2 and the (8-2) th switching element SW8-2 of the MUXs are turned on.

Therefore, during the second horizontal period H2, the plurality of sub-pixels R, G and B disposed on the (4l-3)th row is continuously charged with the data voltage which has been applied during the first horizontal period H1.

Further, during the second horizontal period H2, the data voltage is applied to the plurality of sub-pixels R, G and B disposed on the (4l-2)th row.

That is, during the second horizontal period H2, the blue data voltage Vdata B is applied through the (1-2)th sub-data line DL1-2 to the second sub-pixel B disposed on the (4l-2)th row and the (8k-7)th column. Also, the green data voltage Vdata G is applied through the (2-1)th sub-data line DL2-1 to the third sub-pixel G disposed on the (4l-2)th row and the (8k-6)th column. Further, the red data voltage Vdata R is applied through the (3-2)th sub-data line DL3-2 to the first sub-pixel R disposed on the (4l-2)th row and the (8k-5)th column. Furthermore, the green data voltage Vdata G is applied through the (4-2)th sub-data line DL4-2 to the third sub-pixel G disposed on the (4l-2)th row and the (8k-4)th column. Moreover, the blue data voltage Vdata B is applied through the (5-2)th sub-data line DL5-2 to the second sub-pixel B disposed on the (4l-2)th row and the (8k-3)th column. Also, the green data voltage Vdata G is applied through the (6-1)th sub-data line DL6-1 to the third sub-pixel G disposed on the (4l-2)th row and the (8k-2)th column. Further, the red data voltage Vdata R is applied through the (7-2)th sub-data line DL7-2 to the first sub-pixel R disposed on the (4l-2)th row and the (8k-1)th column. Furthermore, the green data voltage Vdata G is applied through the (8-2)th sub-data line DL8-2 to the third sub-pixel G disposed on the (4l-2)th row and the 8kth column.

Then, in the third horizontal period H3, the second scan voltage Scan2 and the third scan voltage Scan3 have the low level which is the turn-on level and the first enable signal ES1 has the low level which is the turn-on level.

Thus, during the third horizontal period H3, the switching transistors of the plurality of sub-pixels R, G and B disposed on the (4l-2)th row and the (4l-1)th row are turned on. Also, the (1-1)th switching element SW1-1, the (2-2)th switching element SW2-2, the (3-1)th switching element SW3-1, the (4-1)th switching element SW4-1, the (5-1)th switching element SW5-1, the (6-2)th switching element SW6-2, the (7-1)th switching element SW7-1 and the (8-1)th switching element SW8-1 of the MUXs are turned on.

Therefore, during the third horizontal period H3, the plurality of sub-pixels R, G and B disposed on the (4l-2)th row is continuously charged with the data voltage which has been applied during the second horizontal period H2.

Furthermore, during the third horizontal period H3, the data voltage is applied to the plurality of sub-pixels R, G and B disposed on the (4l-1)th row.

That is, during the third horizontal period H3, the red data voltage Vdata R is applied through the (1-1)th sub-data line DL1-1 to the first sub-pixel R disposed on the (4l-1)th row and the (8k-7)th column. Also, the green data voltage Vdata G is applied through the (2-2)th sub-data line DL2-2 to the third sub-pixel G disposed on the (4l-1)th row and the (8k-6)th column. Further, the blue data voltage Vdata B is applied through the (3-1)th sub-data line DL3-1 to the second sub-pixel B disposed on the (4l-1)th row and the (8k-5)th column. Furthermore, the green data voltage Vdata G is applied through the (4-1)th sub-data line DL4-1 to the third sub-pixel G disposed on the (4l-1)th row and the (8k-4)th column. Moreover, the red data voltage Vdata R is applied through the (5-1)th sub-data line DL5-1 to the first sub-pixel R disposed on the (4l-1)th row and the (8k-3)th column. Also, the green data voltage Vdata G is applied through the (6-2)th sub-data line DL6-2 to the third sub-pixel G disposed on the (4l-1)th row and the (8k-2)th column. Further, the blue data voltage Vdata B is applied through the (7-1)th sub-data line DL7-1 to the second sub-pixel B disposed on the (4l-1)th row and the (8k-1)th column. Furthermore, the green data voltage Vdata G is applied through the (8-1)th sub-data line DL8-1 to the third sub-pixel G disposed on the (4l-1)th row and the 8kth column.

Then, in the fourth horizontal period H4, the third scan voltage Scan3 and the fourth scan voltage Scan4 have the low level which is the turn-on level and the second enable signal ES2 has the low level which is the turn-on level.

Thus, during the fourth horizontal period H4, the switching transistors of the plurality of sub-pixels R, G and B disposed on the (4l-1)th row and the 4lth row are turned on. Also, the (1-2)th switching element SW1-2, the (2-1)th switching element SW2-1, the (3-2)th switching element SW3-2, the (4-2)th switching element SW4-2, the (5-2)th switching element SW5-2, the (6-1)th switching element SW6-1, the (7-2)th switching element SW7-2 and the (8-2) th switching element SW8-2 of the MUXs are turned on.

Therefore, during the fourth horizontal period H4, the plurality of sub-pixels R, G and B disposed on the (4l-1)th row is continuously charged with the data voltage which has been applied during the third horizontal period H3.

Furthermore, during the fourth horizontal period H4, the data voltage is applied to the plurality of sub-pixels R, G and B disposed on the 4lth row.

That is, during the fourth horizontal period H4, the blue data voltage Vdata B is applied through the (1-2)th sub-data line DL1-2 to the second sub-pixel B disposed on the 4lth row and the (8k-7)th column. Also, the green data voltage Vdata G is applied through the (2-1)th sub-data line DL2-1 to the third sub-pixel G disposed on the 4lth row and the (8k-6)th column. Furthermore, the red data voltage Vdata R is applied through the (3-2)th sub-data line DL3-2 to the first sub-pixel R disposed on the 4lth row and the (8k-5)th column. Furthermore, the green data voltage Vdata G is applied through the (4-2)th sub-data line DL4-2 to the third sub-pixel G disposed on the 4lth row and the (8k-4)th column. Moreover, the blue data voltage Vdata B is applied through the (5-2)th sub-data line DL5-2 to the second sub-pixel B disposed on the 4lth row and the (8k-3)th column. Also, the green data voltage Vdata G is applied through the (6-1)th sub-data line DL6-1 to the third sub-pixel G disposed on the 4lth row and the (8k-2)th column. Further, the red data voltage Vdata R is applied through the (7-2)th sub-data line DL7-2 to the first sub-pixel R disposed on the 4lth row and the (8k-1)th column. Furthermore, the green data voltage Vdata G is applied through the (8-2)th sub-data line DL8-2 to the third sub-pixel G disposed on the 4lth row and the 8kth column.

Then, in the fifth horizontal period H5, the fourth scan voltage Scan4 has the low level which is the turn-on level.

Thus, during the fifth horizontal period H5, the plurality of sub-pixels R, G and B disposed on the 4lth row is continuously charged with the data voltage which has been applied during the fourth horizontal period H4.

As described above, the display device 100 according to an exemplary embodiment of the present disclosure uses the MUXs MX. Thus, each of the sub-pixels R, G and B may be charged with a data voltage every two horizontal periods. That is, a data voltage is applied to each of the sub-pixels R, G and B during a first horizontal period. During a second horizontal period, each of the sub-pixels R, G and B is continuously charged with the data voltage which has been applied during the first horizontal period.

Therefore, even when the display device according to an exemplary embodiment of the present disclosure is driven fast at 240 Hz, the data voltage may be sufficiently charged during two horizontal periods. Thus, it is possible to achieve an improvement in image quality.

As described above, in the display device according to an exemplary embodiment of the present disclosure, the sub-data lines disposed on one side of each of the plurality of sub-pixels R, G and B include the (1-1)th sub-data line DL1-1, the (2-1)th sub-data line DL2-1, the (3-1)th sub-data line DL3-1, the (4-1)th sub-data line DL4-1, the (5-1)th sub-data line DL5-1, the (6-1)th sub-data line DL6-1, the (7-1)th sub-data line DL7-1 and the (8-1)th sub-data line DL8-1. Also, the sub-data lines disposed on the other side of each of the plurality of sub-pixels R, G and B include the (1-2)th sub-data line DL1-2, the (2-2)th sub-data line DL2-2, the (3-2)th sub-data line DL3-2, the (4-2)th sub-data line DL4-2, the (5-2)th sub-data line DL5-2, the (6-2)th sub-data line DL6-2, the (7-2)th sub-data line DL7-2 and the (8-2)th sub-data line DL8-2.

In a conventional display device, there is a difference in charging time between sub-pixels connected to sub-data lines disposed on one side of the plurality of sub-pixels and sub-pixels connected to sub-data lines disposed on the other side of the plurality of sub-pixels. This is because of a difference between an overlay structure of the sub-data lines disposed on one side of the plurality of sub-pixels and an overlay structure of the sub-data lines disposed on the other side of the plurality of sub-pixels.

Therefore, in the conventional display device, sub-pixels, which are not sufficiently charged with a data voltage, are disposed in the form of a line and thus appear as line dim in a display panel.

However, in the display device according to an exemplary embodiment of the present disclosure, 32 sub-pixel units in an 8×4 matrix form are repeatedly disposed as described above. Thus, sub-pixels, which are not sufficiently charged with a data voltage, may be disposed in the form of a dot.

Specifically, any one third sub-pixel G of a plurality of third sub-pixels G disposed on a row, e.g., the third sub-pixel G disposed on the (4l-3)th row and the (8k-6)th column is connected to the (2-2)th sub-data line DL2-2 disposed on the other side. Therefore, it may be relatively insufficiently charged with a data voltage and thus may output a relatively low luminance.

Also, the third sub-pixel G disposed on the (4l-3)th row and the (8k-4)th column and adjacent in a row direction to the third sub-pixel G disposed on the (4l-3)th row and the (8k-6)th column is connected to the (4-1)th sub-data line DL4-1 disposed on one side. Therefore, it may be relatively sufficiently charged with a data voltage and thus may output a relatively high luminance.

Further, the third sub-pixel G disposed on the (4l-2)th row and the (8k-6)th column and adjacent in a column direction to the third sub-pixel G disposed on the (4l-3)th row and the (8k-6)th column is connected to the (2-1)th sub-data line DL2-1 disposed on one side. Therefore, it may be relatively sufficiently charged with a data voltage and thus may output a relatively high luminance.

That is, the third sub-pixel G adjacent in the row direction or the column direction to the third sub-pixel G disposed on the (4l-3)th row and the (8k-6)th column and outputting a low luminance may output a high luminance.

Thus, in the display device 100 according to an exemplary embodiment of the present disclosure, sub-pixels that output a low luminance and sub-pixels that output a high luminance are disposed in the form of a dot. Therefore, it is possible to remove line dim in the display panel.

Hereinafter, a display device according to another exemplary embodiment of the present disclosure will be described focusing on differences in a connection relationship between sub-pixels.

Figure 5:
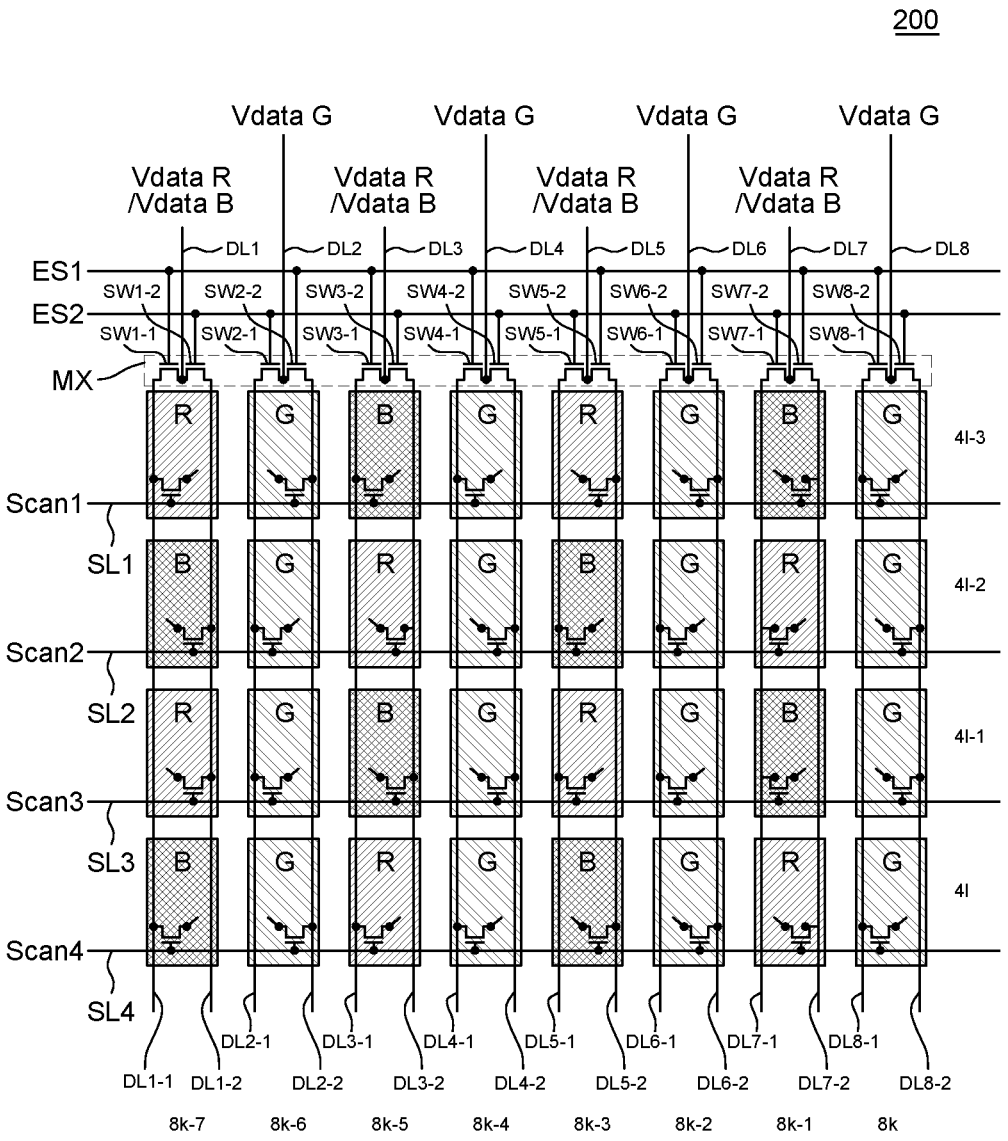
FIG. 5 is a block diagram for explaining a placement relationship of sub-pixels in a display device according to another exemplary embodiment of the present disclosure.

FIG. 5 is a block diagram for explaining a placement relationship of sub-pixels in the display device according to another exemplary embodiment of the present disclosure.

For the convenience of description, FIG. 5 illustrates only the 32 sub-pixels R, G and B disposed in an 8×4 matrix form on the (4l-3)th row to the 4lth row and on the (8k-7)th column to the 8kth column. In the display area, the placement relationship of 32 sub-pixels R, G and B disposed in an 8×4 matrix form is repeated. Further, transistors disposed between the sub-pixels R, G and B and the data lines DL1 to DL8 are the switching transistors SWT described above with reference to FIG. 2 (herein, each of l and k is a natural number of 1 or more).

Referring to FIG. 5, each pixel PX includes three sub-pixels R, G and B. For example, each pixel PX may include the first sub-pixel R, the second sub-pixel B and the third sub-pixel G as shown in FIG. 5. Also, the first sub-pixel R may be a red sub-pixel, the second sub-pixel B may be a blue sub-pixel and the third sub-pixel G may be a green sub-pixel. However, the present disclosure is not limited thereto. The plurality of sub-pixels R, G and B may be changed to various color sub-pixels (magenta, yellow and cyan sub-pixels).

Further, the first sub-pixels R and the second sub-pixels B may be alternately disposed on odd-numbered columns and only the third sub-pixels G may be disposed on even-numbered columns.

As shown in FIG. 5, the first sub-pixels R and the second sub-pixels B may be alternately disposed on each of the (8k-7)th column, the (8k-5)th column, the (8k-3)th column and the (8k-1)th column Only the third sub-pixels G may be disposed on each of the (8k-6)th column, the (8k-4)th column, the (8k-2)th column and the 8kth column.

Specifically, on each of the (8k-7)th column and the (8k-3)th column, the first sub-pixels R are disposed on the (4l-3)th row and the (4l-1)th row and the second sub-pixels B are disposed on the (4l-2)th row and the 4lth row. Further, on each of the (8k-5)th column and the (8k-1)th column, the second sub-pixels B are disposed on the (4l-3)th row and the (4l-1)th row and the first sub-pixels R are disposed on the (4l-2)th row and the 4lth row.

Further, the first scan line SL1 is connected to the plurality of sub-pixels R, G and B disposed on the (4l-3)th row and supplies the first scan voltage Scan1 to the plurality of sub-pixels R, G and B disposed on the (4l-3)th row. Also, the second scan line SL2 is connected to the plurality of sub-pixels R, G and B disposed on the (4l-2)th row and supplies the second scan voltage Scan2 to the plurality of sub-pixels R, G and B disposed on the (4l-2)th row. Further, the third scan line SL3 is connected to the plurality of sub-pixels R, G and B disposed on the (4l-1)th row and supplies the third scan voltage Scan3 to the plurality of sub-pixels R, G and B disposed on the (4l-1)th row. Furthermore, the fourth scan line SL4 is connected to the plurality of sub-pixels R, G and B disposed on the 4lth row and supplies the fourth scan voltage Scan4 to the plurality of sub-pixels R, G and B disposed on the 4lth row.

Also, the red data voltage Vdata R and the blue data voltage Vdata B may be sequentially applied to the odd-numbered data lines, i.e., the first data line DL1, the third data line DL3, the fifth data line DL5 and the seventh data line DL7.

Specifically, the first data line DL1 applies the red data voltage Vdata R to the first sub-pixels R disposed on the (8k-7)th column and the blue data voltage Vdata B to the second sub-pixels B disposed on the (8k-7)th column. Further, the third data line DL3 applies the red data voltage Vdata R to the first sub-pixels R disposed on the (8k-5)th column and the blue data voltage Vdata B to the second sub-pixels B disposed on the (8k-5)th column. Furthermore, the fifth data line DL5 applies the red data voltage Vdata R to the first sub-pixels R disposed on the (8k-3)th column and the blue data voltage Vdata B to the second sub-pixels B disposed on the (8k-3)th column. Moreover, the seventh data line DL7 applies the red data voltage Vdata R to the first sub-pixels R disposed on the (8k-1)th column and the blue data voltage Vdata B to the second sub-pixels B disposed on the (8k-1)th column.

Also, the green data voltage Vdata G may be sequentially applied to the even-numbered data lines (e.g., the second data line DL2, the fourth data line DL4, the sixth data line DL6 and the eighth data line DL8).

Specifically, the second data line DL2 applies the green data voltage Vdata G to the third sub-pixels G disposed on the (8k-6)th column. Also, the fourth data line DL4 applies the green data voltage Vdata G to the third sub-pixels G disposed on the (8k-4)th column. Further, the sixth data line DL6 applies the green data voltage Vdata G to the third sub-pixels G disposed on the (8k-2)th column. Furthermore, the eighth data line DL8 applies the green data voltage Vdata G to the third sub-pixels G disposed on the 8kth column.

Further, each of the plurality of data lines DL1 to DL8 may branch into the plurality of sub-data lines DL1-1 to DL8-2 through the MUX.

Specifically, the first data line DL1 may branch into the (1-1)th sub-data line DL1-1 and the (1-2)th sub-data line DL1-2. The above-described (1-1)th sub-data line DL1-1 is disposed on one side of the plurality of sub-pixels R and B disposed on the (8k-7)th column. The above-described (1-2)th sub-data line DL1-2 is disposed on the other side of the plurality of sub-pixels R and B disposed on the (8k-7)th column.

Also, the second data line DL2 may branch into the (2-1)th sub-data line DL2-1 and the (2-2)th sub-data line DL2-2. The above-described (2-1)th sub-data line DL2-1 is disposed on one side of the plurality of sub-pixels G disposed on the (8k-6)th column. The above-described (2-2)th sub-data line DL2-2 is disposed on the other side of the plurality of sub-pixels G disposed on the (8k-6)th column.

Further, the third data line DL3 may branch into the (3-1)th sub-data line DL3-1 and the (3-2)th sub-data line DL3-2. The above-described (3-1)th sub-data line DL3-1 is disposed on one side of the plurality of sub-pixels R and B disposed on the (8k-5)th column. The above-described (3-2)th sub-data line DL3-2 is disposed on the other side of the plurality of sub-pixels R and B disposed on the (8k-5)th column.

Furthermore, the fourth data line DL4 may branch into the (4-1)th sub-data line DL4-1 and the (4-2)th sub-data line DL4-2. The above-described (4-1)th sub-data line DL4-1 is disposed on one side of the plurality of sub-pixels G disposed on the (8k-4)th column. The above-described (4-2)th sub-data line DL4-2 is disposed on the other side of the plurality of sub-pixels G disposed on the (8k-4)th column.

Moreover, the fifth data line DL5 may branch into the (5-1)th sub-data line DL5-1 and the (5-2)th sub-data line DL5-2. The above-described (5-1)th sub-data line DL5-1 is disposed on one side of the plurality of sub-pixels R and B disposed on the (8k-3)th column. The above-described (5-2)th sub-data line DL5-2 is disposed on the other side of the plurality of sub-pixels R and B disposed on the (8k-3)th column.

Also, the sixth data line DL6 may branch into the (6-1)th sub-data line DL6-1 and the (6-2)th sub-data line DL6-2. The above-described (6-1)th sub-data line DL6-1 is disposed on one side of the plurality of sub-pixels G disposed on the (8k-2)th column. The above-described (6-2)th sub-data line DL6-2 is disposed on the other side of the plurality of sub-pixels G disposed on the (8k-2)th column.

Further, the seventh data line DL7 may branch into the (7-1)th sub-data line DL7-1 and the (7-2)th sub-data line DL7-2. The above-described (7-1)th sub-data line DL7-1 is disposed on one side of the plurality of sub-pixels R and B disposed on the (8k-1)th column. The above-described (7-2)th sub-data line DL7-2 is disposed on the other side of the plurality of sub-pixels R and B disposed on the (8k-1)th column.

Furthermore, the eighth data line DL8 may branch into the (8-1)th sub-data line DL8-1 and the (8-2)th sub-data line DL8-2. The above-described (8-1)th sub-data line DL8-1 is disposed on one side of the plurality of sub-pixels G disposed on the 8kth column. The above-described (8-2)th sub-data line DL8-2 is disposed on the other side of the plurality of sub-pixels G disposed on the 8kth column.

Also, the (1-1)th sub-data line DL1-1 is connected to the first sub-pixel R disposed on the (4l-3)th row and the (8k-7)th column and the second sub-pixel B disposed on the 4lth row and the (8k-7)th column.

Further, the (1-2)th sub-data line DL1-2 is connected to the second sub-pixel B disposed on the (4l-2)th row and the (8k-7)th column and the first sub-pixel R disposed on the (4l-1)th row and the (8k-7)th column.

Furthermore, the (2-1)th sub-data line DL2-1 and the (2-2)th sub-data line DL2-2 are connected to the third sub-pixels G disposed on the (8k-6)th column. That is, the (2-1)th sub-data line DL2-1 is connected to the third sub-pixel G disposed on the (4l-2)th row and the (8k-6)th column and the third sub-pixel G disposed on the (4l-1)th row and the (8k-6)th column. Also, the (2-2)th sub-data line DL2-2 is connected to the third sub-pixel G disposed on the (4l-3)th row and the (8k-6)th column and the third sub-pixel G disposed on the 4lth row and the (8k-6)th column.

Moreover, the (3-1)th sub-data line DL3-1 is connected to the second sub-pixel B disposed on the (4l-3)th row and the (8k-5)th column and the first sub-pixel R disposed on the 4lth row and the (8k-5)th column.

Further, the (3-2)th sub-data line DL3-2 is connected to the first sub-pixel R disposed on the (4l-2)th row and the (8k-5)th column and the second sub-pixel B disposed on the (4l-1)th row and the (8k-5)th column.

Furthermore, the (4-1)th sub-data line DL4-1 and the (4-2)th sub-data line DL4-2 are connected to the third sub-pixels G disposed on the (8k-4)th column. That is, the (4-1)th sub-data line DL4-1 is connected to the third sub-pixel G disposed on the (4l-3)th row and the (8k-4)th column and the third sub-pixel G disposed on the 4lth row and the (8k-4)th column. Also, the (4-2)th sub-data line DL4-2 is connected to the third sub-pixel G disposed on the (4l-2)th row and the (8k-4)th column and the third sub-pixel G disposed on the (4l-1)th row and the (8k-4)th column.

Moreover, the (5-1)th sub-data line DL5-1 is connected to the second sub-pixel B disposed on the (4l-2)th row and the (8k-3)th column and the first sub-pixel R disposed on the (4l-1)th row and the (8k-3)th column.

Also, the (5-2)th sub-data line DL5-2 is connected to the first sub-pixel R disposed on the (4l-3)th row and the (8k-3)th column and the second sub-pixel B disposed on the 4lth row and the (8k-3)th column.

Further, the (6-1)th sub-data line DL6-1 and the (6-2)th sub-data line DL6-2 are connected to the third sub-pixels G disposed on the (8k-2)th column. That is, the (6-1)th sub-data line DL6-1 is connected to the third sub-pixel G disposed on the (4l-2)th row and the (8k-2)th column and the third sub-pixel G disposed on the (4l-1)th row and the (8k-2)th column. Also, the (6-2)th sub-data line DL6-2 is connected to the third sub-pixel G disposed on the (4l-3)th row and the (8k-2)th column and the third sub-pixel G disposed on the 4lth row and the (8k-2)th column.

Furthermore, the (7-1)th sub-data line DL7-1 is connected to the second sub-pixel B disposed on the (4l-3)th row and the (8k-1)th column and the first sub-pixel R disposed on the 4lth row and the (8k-1)th column.

Moreover, the (7-2)th sub-data line DL7-2 is connected to the second sub-pixel B disposed on the (4l-3)th row and the (8k-1)th column and the first sub-pixel R disposed on the 4lth row and the (8k-1)th column.

Also, the (8-1)th sub-data line DL8-1 and the (8-2)th sub-data line DL8-2 are connected to the third sub-pixels G disposed on the 8kth column That is, the (8-1)th sub-data line DL8-1 is connected to the third sub-pixel G disposed on the (4l-3)th row and the 8kth column and the third sub-pixel G disposed on the 4lth row and the 8kth column. Further, the (8-2)th sub-data line DL8-2 is connected to the third sub-pixel G disposed on the (4l-2)th row and the 8kth column and the third sub-pixel G disposed on the (4l-1)th row and the 8kth column.

The MUXs MX are disposed between the plurality of data lines DL1 to DL8 and the plurality of sub-data lines DL1-1 to DL8-2. Further, the MUXs MX are connected to the plurality of data lines DL1 to DL8 and the plurality of sub-data lines DL1-1 to DL8-2 and determine a connection relationship between the plurality of data lines DL1 to DL8 and the plurality of sub-data lines DL1-1 to DL8-2.

The MUXs MX include the plurality of switching elements SW1-1 to SW8-2. Each of the plurality of switching elements SW1-1 to SW8-2 connects each of the plurality of data lines DL1 to DL8 to any one of the plurality of sub-data lines DL1-1 to DL8-2 branching from each of the plurality of data lines DL1 to DL8 depending on the first enable signal ES1 and the second enable signal ES2.

That is, the MUXs MX include the (1-1)th switching element SW1-1 and the (1-2)th switching element SW1-2 connected to the first data line DL1 and the (2-1)th switching element SW2-1 and the (2-2)th switching element SW2-2 connected to the second data line DL2. Also, the MUXs MX include the (3-1)th switching element SW3-1 and the (3-2)th switching element SW3-2 connected to the third data line DL3 and the (4-1)th switching element SW4-1 and the (4-2)th switching element SW4-2 connected to the fourth data line DL4. Further, the MUXs MX include the (5-1)th switching element SW5-1 and the (5-2)th switching element SW5-2 connected to the fifth data line DL5 and the (6-1)th switching element SW6-1 and the (6-2)th switching element SW6-2 connected to the sixth data line DL6. Furthermore, the MUXs MX include the (7-1)th switching element SW7-1 and the (7-2)th switching element SW7-2 connected to the seventh data line DL7 and the (8-1)th switching element SW8-1 and the (8-2)th switching element SW8-2 connected to the eighth data line DL8.

Specifically, the (1-1)th switching element SW1-1 includes the gate electrode to which the first enable signal ES1 is applied and the drain electrode connected to the first data line DL1. Also, the (1-1)th switching element SW1-1 includes the source electrode connected to the (1-1)th sub-data line DL1-1. Thus, when the first enable signal ES1 has a low level, the (1-1)th switching element SW1-1 is turned on and the first data line DL1 and the (1-1)th sub-data line DL1-1 are electrically connected to each other.

The (1-2)th switching element SW1-2 includes the gate electrode to which the second enable signal ES2 is applied and the drain electrode connected to the first data line DL1. Also, the (1-2)th switching element SW1-2 includes the source electrode connected to the (1-2)th sub-data line DL1-2. Thus, when the second enable signal ES2 has a low level, the (1-2)th switching element SW1-2 is turned on and the first data line DL1 and the (1-2)th sub-data line DL1-2 are electrically connected to each other.

Furthermore, the (2-1)th switching element SW2-1 includes the gate electrode to which the second enable signal ES2 is applied and the drain electrode connected to the second data line DL2. Also, the (2-1)th switching element SW2-1 includes the source electrode connected to the (2-1) th sub-data line DL2-1. Thus, when the second enable signal ES2 has a low level, the (2-1)th switching element SW2-1 is turned on and the second data line DL2 and the (2-1)th sub-data line DL2-1 are electrically connected to each other.

The (2-2)th switching element SW2-2 includes the gate electrode to which the first enable signal ES1 is applied and the drain electrode connected to the second data line DL2. Also, the (2-2)th switching element SW2-2 includes the source electrode connected to the (2-2)th sub-data line DL2-2. Thus, when the first enable signal ES1 has a low level, the (2-2)th switching element SW2-2 is turned on and the second data line DL2 and the (2-2)th sub-data line DL2-2 are electrically connected to each other.

Furthermore, the (3-1)th switching element SW3-1 includes the gate electrode to which the first enable signal ES1 is applied and the drain electrode connected to the third data line DL3. Also, the (3-1)th switching element SW3-1 includes the source electrode connected to the (3-1)th sub-data line DL3-1. Thus, when the first enable signal ES1 has a low level, the (3-1)th switching element SW3-1 is turned on and the third data line DL3 and the (3-1)th sub-data line DL3-1 are electrically connected to each other.

The (3-2)th switching element SW3-2 includes the gate electrode to which the second enable signal ES2 is applied and the drain electrode connected to the third data line DL3. Also, the (3-2)th switching element SW3-2 includes the source electrode connected to the (3-2)th sub-data line DL3-2. Thus, when the second enable signal ES2 has a low level, the (3-2)th switching element SW3-2 is turned on and the third data line DL3 and the (3-2)th sub-data line DL3-2 are electrically connected to each other.

Furthermore, the (4-1)th switching element SW4-1 includes the gate electrode to which the first enable signal ES1 is applied and the drain electrode connected the fourth data line DL4. Also, the (4-1)th switching element SW4-1 includes the source electrode connected to the (4-1)th sub-data line DL4-1. Thus, when the first enable signal ES1 has a low level, the (4-1)th switching element SW4-1 is turned on and the fourth data line DL4 and the (4-1)th sub-data line DL4-1 are electrically connected to each other.

The (4-2)th switching element SW4-2 includes the gate electrode to which the second enable signal ES2 is applied and the drain electrode connected the fourth data line DL4. Also, the (4-2)th switching element SW4-2 includes the source electrode connected to the (4-2)th sub-data line DL4-2. Thus, when the second enable signal ES2 has a low level, the (4-2)th switching element SW4-2 is turned on and the fourth data line DL4 and the (4-2)th sub-data line DL4-2 are electrically connected to each other.

Furthermore, the (5-1)th switching element SW5-1 includes the gate electrode to which the second enable signal ES2 is applied and the drain electrode connected the fifth data line DL5. Also, the (5-1)th switching element SW5-1 includes the source electrode connected to the (5-1)th sub-data line DL5-1. Thus, when the second enable signal ES2 has a low level, the (5-1)th switching element SW5-1 is turned on and the fifth data line DL5 and the (5-1)th sub-data line DL5-1 are electrically connected to each other.

The (5-2)th switching element SW5-2 includes the gate electrode to which the first enable signal ES1 is applied and the drain electrode connected to the fifth data line DL5. Also, the (5-2)th switching element SW5-2 includes the source electrode connected to the (5-2)th sub-data line DL5-2. Thus, when the first enable signal ES1 has a low level, the (5-2)th switching element SW5-2 is turned on and the fifth data line DL5 and the (5-2)th sub-data line DL5-2 are electrically connected to each other.

Furthermore, the (6-1)th switching element SW6-1 includes the gate electrode to which the second enable signal ES2 is applied and the drain electrode connected to the sixth data line DL6. Also, the (6-1)th switching element SW6-1 includes the source electrode connected to the (6-1)th sub-data line DL6-1. Thus, when the second enable signal ES2 has a low level, the (6-1)th switching element SW6-1 is turned on and the sixth data line DL6 and the (6-1)th sub-data line DL6-1 are electrically connected to each other.

The (6-2)th switching element SW6-2 includes the gate electrode to which the first enable signal ES1 is applied and the drain electrode connected to the sixth data line DL6. Also, the (6-2)th switching element SW6-2 includes the source electrode connected to the (6-2)th sub-data line DL6-2. Thus, when the first enable signal ES1 has a low level, the (6-2)th switching element SW6-2 is turned on and the sixth data line DL6 and the (6-2)th sub-data line DL6-2 are electrically connected to each other.

Furthermore, the (7-1)th switching element SW7-1 includes the gate electrode to which the second enable signal ES2 is applied and the drain electrode connected to the seventh data line DL7. Also, the (7-1)th switching element SW7-1 includes the source electrode connected to the (7-1)th sub-data line DL7-1. Thus, when the second enable signal ES2 has a low level, the (7-1)th switching element SW7-1 is turned on and the seventh data line DL7 and the (7-1)th sub-data line DL7-1 are electrically connected to each other.

The (7-2)th switching element SW7-2 includes the gate electrode to which the first enable signal ES1 is applied and the drain electrode connected to the seventh data line DL7. Also, the (7-2)th switching element SW7-2 includes the source electrode connected to the (7-2)th sub-data line DL7-2. Thus, when the first enable signal ES1 has a low level, the (7-2)th switching element SW7-2 is turned on and the seventh data line DL7 and the (7-2)th sub-data line DL7-2 are electrically connected to each other.

Furthermore, the (8-1)th switching element SW8-1 includes the gate electrode to which the first enable signal ES1 is applied and the drain electrode connected to the eighth data line DL8. Also, the (8-1)th switching element SW8-1 includes the source electrode connected to the (8-1)th sub-data line DL8-1. Thus, when the first enable signal ES1 has a low level, the (8-1)th switching element SW8-1 is turned on and the eighth data line DL8 and the (8-1)th sub-data line DL8-1 are electrically connected to each other.

The (8-2)th switching element SW8-2 includes the gate electrode to which the second enable signal ES2 is applied and the drain electrode connected to the eighth data line DL8. Also, the (8-2)th switching element SW8-2 includes the source electrode connected to the (8-2)th sub-data line DL8-2. Thus, when the second enable signal ES2 has a low level, the (8-2)th switching element SW8-2 is turned on and the eighth data line DL8 and the (8-2)th sub-data line DL8-2 are electrically connected to each other.

Hereinafter, a method for driving the display device according to another exemplary embodiment of the present disclosure will be described with reference to FIG. 6.

Figure 6:
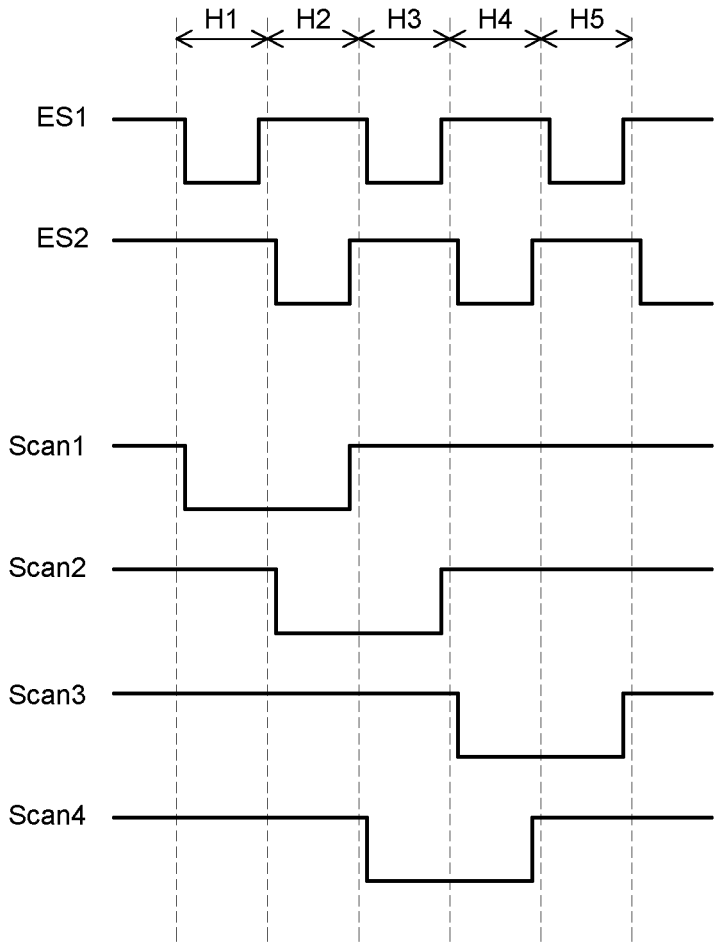
FIG. 6 is a timing chart of enable signals and scan voltages of the display device according to another exemplary embodiment of the present disclosure.

FIG. 6 is a timing chart of enable signals and scan voltages of the display device according to another exemplary embodiment of the present disclosure.

As shown in FIG. 6, the first enable signal ES1 is a square wave inverted every horizontal period. Also, the second enable signal ES2 is a square wave whose phase is inverted with respect to the first enable signal ES1 and which is inverted every horizontal period.

That is, in each of the first horizontal period H1, the third horizontal period H3 and the fifth horizontal period H5, the first enable signal ES1 has the low level which is the turn-on level and the second enable signal ES2 has the high level which is the turn-off level. Also, in each of the second horizontal period H2 and the fourth horizontal period H4, the first enable signal ES1 has the high level which is the turn-off level and the first enable signal ES1 has the low level which is the turn-on level.

Furthermore, the first scan voltage Scant is output at the low level which is the turn-on level in the first horizontal period H1 and the second horizontal period H2. Also, the second scan voltage Scan2 is output at the low level which is the turn-on level in the second horizontal period H2 and the third horizontal period H3. Further, the fourth scan voltage Scan4 is output at the low level which is the turn-on level in the third horizontal period H3 and the fourth horizontal period H4. Furthermore, the third scan voltage Scan3 is output at the low level which is the turn-on level in the fourth horizontal period H4 and the fifth horizontal period H5.

As shown in FIG. 6, in the first horizontal period H1, the first scan voltage Scant has the low level which is the turn-on level and the first enable signal ES1 has the low level which is the turn-on level.

Thus, during the first horizontal period H1, the switching transistors of the plurality of sub-pixels R, G and B disposed on the (4l-3)th row are turned on. Also, the (1-1)th switching element SW1-1, the (2-2)th switching element SW2-2, the (3-1)th switching element SW3-1, the (4-1)th switching element SW4-1, the (5-2)th switching element SW5-2, the (6-2)th switching element SW6-2, the (7-2)th switching element SW7-2 and the (8-1)th switching element SW8-1 of the MUXs are turned on.

Therefore, during the first horizontal period H1, a data voltage is applied to the plurality of sub-pixels R, G and B disposed on the (4l-3)th row.

That is, during the first horizontal period H1, the red data voltage Vdata R is applied through the (1-1)th sub-data line DL1-1 to the first sub-pixel R disposed on the (4l-3)th row and the (8k-7)th column. Also, the green data voltage Vdata G is applied through the (2-2)th sub-data line DL2-2 to the third sub-pixel G disposed on the (4l-3)th row and the (8k-6)th column. Further, the blue data voltage Vdata B is applied through the (3-1)th sub-data line DL3-1 to the second sub-pixel B disposed on the (4l-3)th row and the (8k-5)th column. Furthermore, the green data voltage Vdata G is applied through the (4-1)th sub-data line DL4-1 to the third sub-pixel G disposed on the (4l-3)th row and the (8k-4)th column. Moreover, the red data voltage Vdata R is applied through the (5-2)th sub-data line DL5-2 to the first sub-pixel R disposed on the (4l-3)th row and the (8k-3)th column. Also, the green data voltage Vdata G is applied through the (6-2)th sub-data line DL6-2 to the third sub-pixel G disposed on the (4l-3)th row and the (8k-2)th column. Further, the blue data voltage Vdata B is applied through the (7-2)th sub-data line DL7-2 to the second sub-pixel B disposed on the (4l-3)th row and the (8k-1)th column. Furthermore, the green data voltage Vdata G is applied through the (8-1)th sub-data line DL8-1 to the third sub-pixel G disposed on the (4l-3)th row and the 8kth column.

Then, in the second horizontal period H2, the first scan voltage Scan1 and the second scan voltage Scan2 have the low level which is the turn-on level and the second enable signal ES2 has the low level which is the turn-on level.

Thus, during the second horizontal period H2, the switching transistors of the plurality of sub-pixels R, G and B disposed on the (4l-3)th row and the (4l-2)th row are turned on. Also, the (1-2)th switching element SW1-2, the (2-1)th switching element SW2-1, the (3-2)th switching element SW3-2, the (4-2)th switching element SW4-2, the (5-1)th switching element SW5-1, the (6-1)th switching element SW6-1, the (7-1)th switching element SW7-1 and the (8-2)th switching element SW8-2 of the MUXs are turned on.

Therefore, during the second horizontal period H2, the plurality of sub-pixels R, G and B disposed on the (4l-3)th row is continuously charged with the data voltage which has been applied during the first horizontal period H1.

Further, during the second horizontal period H2, the data voltage is applied to the plurality of sub-pixels R, G and B disposed on the (4l-2)th row.

That is, during the second horizontal period H2, the blue data voltage Vdata B is applied through the (1-2)th sub-data line DL1-2 to the second sub-pixel B disposed on the (4l-2)th row and the (8k-7)th column. Also, the green data voltage Vdata G is applied through the (2-1)th sub-data line DL2-1 to the third sub-pixel G disposed on the (4l-2)th row and the (8k-6)th column. Further, the red data voltage Vdata R is applied through the (3-2)th sub-data line DL3-2 to the first sub-pixel R disposed on the (4l-2)th row and the (8k-5)th column. Furthermore, the green data voltage Vdata G is applied through the (4-2)th sub-data line DL4-2 to the third sub-pixel G disposed on the (4l-2)th row and the (8k-4)th column. Moreover, the blue data voltage Vdata B is applied through the (5-1)th sub-data line DL5-1 to the second sub-pixel B disposed on the (4l-2)th row and the (8k-3)th column. Also, the green data voltage Vdata G is applied through the (6-1)th sub-data line DL6-1 to the third sub-pixel G disposed on the (4l-2)th row and the (8k-2)th column. Further, the red data voltage Vdata R is applied through the (7-1)th sub-data line DL7-1 to the first sub-pixel R disposed on the (4l-2)th row and the (8k-1)th column. Furthermore, the green data voltage Vdata G is applied through the (8-2)th sub-data line DL8-2 to the third sub-pixel G disposed on the (4l-2)th row and the 8kth column.

Then, in the third horizontal period H3, the second scan voltage Scan2 and the fourth scan voltage Scan4 have the low level which is the turn-on level and the first enable signal ES1 has the low level which is the turn-on level.

Thus, during the third horizontal period H3, the switching transistors of the plurality of sub-pixels R, G and B disposed on the (4l-2)th row and the 4lth row are turned on. Also, the (1-1)th switching element SW1-1, the (2-2)th switching element SW2-2, the (3-1)th switching element SW3-1, the (4-1)th switching element SW4-1, the (5-2)th switching element SW5-2, the (6-2)th switching element SW6-2, the (7-2)th switching element SW7-2 and the (8-1)th switching element SW8-1 of the MUXs are turned on.

Therefore, during the third horizontal period H3, the plurality of sub-pixels R, G and B disposed on the (4l-2)th row is continuously charged with the data voltage which has been applied during the second horizontal period H2.

Further, during the third horizontal period H3, the data voltage is applied to the plurality of sub-pixels R, G and B disposed on the 4lth row.

That is, during the third horizontal period H3, the blue data voltage Vdata B is applied through the (1-1)th sub-data line DL1-1 to the second sub-pixel B disposed on the 4lth row and the (8k-7)th column. Also, the green data voltage Vdata G is applied through the (2-2)th sub-data line DL2-2 to the third sub-pixel G disposed on the 4lth row and the (8k-6)th column. Further, the red data voltage Vdata R is applied through the (3-1)th sub-data line DL3-1 to the first sub-pixel R disposed on the 4lth row and the (8k-5)th column. Furthermore, the green data voltage Vdata G is applied through the (4-1)th sub-data line DL4-1 to the third sub-pixel G disposed on the 4lth row and the (8k-4)th column. Moreover, the blue data voltage Vdata B is applied through the (5-1)th sub-data line DL5-1 to the second sub-pixel B disposed on the 4lth row and the (8k-3)th column. Also, the green data voltage Vdata G is applied through the (6-2)th sub-data line DL6-2 to the third sub-pixel G disposed on the 4lth row and the (8k-2)th column. Further, the red data voltage Vdata R is applied through the (7-1)th sub-data line DL7-1 to the first sub-pixel R disposed on the 4lth row and the (8k-1)th column. Furthermore, the green data voltage Vdata G is applied through the (8-1)th sub-data line DL8-1 to the third sub-pixel G disposed on the 4lth row and the 8kth column.

Then, in the fourth horizontal period H4, the third scan voltage Scan3 and the fourth scan voltage Scan4 have the low level which is the turn-on level and the second enable signal ES2 has the low level which is the turn-on level.

Thus, during the fourth horizontal period H4, the switching transistors of the plurality of sub-pixels R, G and B disposed on the (4l-1)th row and the 4lth row are turned on. Also, the (1-2)th switching element SW1-2, the (2-1)th switching element SW2-1, the (3-2)th switching element SW3-2, the (4-2)th switching element SW4-2, the (5-1)th switching element SW5-1, the (6-1)th switching element SW6-1, the (7-1)th switching element SW7-1 and the (8-2) th switching element SW8-2 of the MUXs are turned on.

Therefore, during the fourth horizontal period H4, the plurality of sub-pixels R, G and B disposed on the 4lth row is continuously charged with the data voltage which has been applied during the third horizontal period H3.

Furthermore, during the fourth horizontal period H4, the data voltage is applied to the plurality of sub-pixels R, G and B disposed on the (4l-1)th row.

That is, during the fourth horizontal period H4, the red data voltage Vdata R is applied through the (1-2)th sub-data line DL1-2 to the first sub-pixel R disposed on the (4l-2)th row and the (8k-7)th column. Also, the green data voltage Vdata G is applied through the (2-1)th sub-data line DL2-1 to the third sub-pixel G disposed on the (4l-2)th row and the (8k-6)th column. Furthermore, the blue data voltage Vdata B is applied through the (3-2)th sub-data line DL3-2 to the second sub-pixel B disposed on the (4l-2)th row and the (8k-5)th column. Furthermore, the green data voltage Vdata G is applied through the (4-2)th sub-data line DL4-2 to the third sub-pixel G disposed on the (4l-2)th row and the (8k-4)th column. Moreover, the red data voltage Vdata R is applied through the (5-2)th sub-data line DL5-2 to the first sub-pixel R disposed on the (4l-2)th row and the (8k-3)th column. Also, the green data voltage Vdata G is applied through the (6-1)th sub-data line DL6-1 to the third sub-pixel G disposed on the (4l-2)th row and the (8k-2)th column. Further, the blue data voltage Vdata B is applied through the (7-2)th sub-data line DL7-2 to the second sub-pixel B disposed on the (4l-2)th row and the (8k-1)th column. Furthermore, the green data voltage Vdata G is applied through the (8-2)th sub-data line DL8-2 to the third sub-pixel G disposed on the (4l-2)th row and the 8kth column.

Then, in the fifth horizontal period H5, the third scan voltage Scan3 has the low level which is the turn-on level.

Thus, during the fifth horizontal period H5, the plurality of sub-pixels R, G and B disposed on the (4l-1)th row is continuously charged with the data voltage which has been applied during the fourth horizontal period H4.

As described above, a display device 200 according to another exemplary embodiment of the present disclosure uses the MUXs MX. Thus, each of the sub-pixels R, G and B may be charged with a data voltage every two horizontal periods. That is, a data voltage is applied to each of the sub-pixels R, G and B during a first horizontal period. During a second horizontal period, each of the sub-pixels R, G and B is continuously charged with the data voltage which has been applied during the first horizontal period.

Therefore, even when the display device according to another exemplary embodiment of the present disclosure is driven fast at 240 Hz, the data voltage may be sufficiently charged during two horizontal periods. Thus, it is possible to achieve an improvement in image quality.

As described above, in the display device according to another exemplary embodiment of the present disclosure, the sub-data lines disposed on one side of each of the plurality of sub-pixels R, G and B include the (1-1)th sub-data line DL1-1, the (2-1)th sub-data line DL2-1, the (3-1)th sub-data line DL3-1, the (4-1)th sub-data line DL4-1, the (5-1)th sub-data line DL5-1, the (6-1)th sub-data line DL6-1, the (7-1)th sub-data line DL7-1 and the (8-1)th sub-data line DL8-1. Also, the sub-data lines disposed on the other side of each of the plurality of sub-pixels R, G and B include the (1-2)th sub-data line DL1-2, the (2-2)th sub-data line DL2-2, the (3-2)th sub-data line DL3-2, the (4-2)th sub-data line DL4-2, the (5-2)th sub-data line DL5-2, the (6-2)th sub-data line DL6-2, the (7-2)th sub-data line DL7-2 and the (8-2)th sub-data line DL8-2.

In a conventional display device, there is a difference in charging time between sub-pixels connected to sub-data lines disposed on one side of the plurality of sub-pixels and sub-pixels connected to sub-data lines disposed on the other side of the plurality of sub-pixels. This is because of a difference between an overlay structure of the sub-data lines disposed on one side of the plurality of sub-pixels and an overlay structure of the sub-data lines disposed on the other side of the plurality of sub-pixels.

Therefore, in the conventional display device, sub-pixels, which are not sufficiently charged with a data voltage, are disposed in the form of a line and thus appear as line dim in a display panel.

However, in the display device according to another exemplary embodiment of the present disclosure, 32 sub-pixel units in an 8×4 matrix form are repeatedly disposed as described above. Thus, sub-pixels, which are not sufficiently charged with a data voltage, may be disposed in the form of a dot.

Specifically, any one third sub-pixel G of a plurality of third sub-pixels G disposed on a row, e.g., the third sub-pixel G disposed on the (4l-3)th row and the (8k-6)th column is connected to the (2-2)th sub-data line DL2-2 disposed on the other side. Therefore, it may be relatively insufficiently charged with a data voltage and thus may output a relatively low luminance.

Also, the third sub-pixel G disposed on the (4l-3)th row and the (8k-4)th column and adjacent in a row direction to the third sub-pixel G disposed on the (4l-3)th row and the (8k-6)th column is connected to the (4-1)th sub-data line DL4-1 disposed on one side. Therefore, it may be relatively sufficiently charged with a data voltage and thus may output a relatively high luminance.

Furthermore, the third sub-pixel G disposed on the (4l-2)th row and the (8k-6)th column and adjacent in a column direction to the third sub-pixel G disposed on the (4l-3)th row and the (8k-6)th column is connected to the (2-1)th sub-data line DL2-1 disposed on one side. Therefore, it may be relatively sufficiently charged with a data voltage and thus may output a relatively high luminance.

That is, the third sub-pixel G adjacent in the row direction or the column direction to the third sub-pixel G disposed on the (4l-3)th row and the (8k-6)th column and outputting a low luminance may output a high luminance.

Thus, in the display device 200 according to another exemplary embodiment of the present disclosure, sub-pixels that output a low luminance and sub-pixels that output a high luminance are disposed in the form of a dot. Therefore, it is possible to remove line dim in the display panel.

The exemplary embodiments of the present disclosure can also be described as follows:

According to an aspect of the present disclosure, the display device includes a display panel in which a plurality of sub-pixels is repeatedly disposed in a matrix form. The display device further includes a data driver configured to supply a data voltage to the plurality of sub-pixels via a plurality of data lines. The display device also includes a gate driver configured to supply a scan signal to the plurality of sub-pixels via a plurality of scan lines. The plurality of sub-pixels includes first sub-pixels, second sub-pixels and third sub-pixels having different colors each other. The first sub-pixels and the second sub-pixels are alternately disposed on odd-numbered columns and the third sub-pixels are disposed on even-numbered columns. Each of the plurality of data lines branches into a plurality of sub-data lines through a MUX, and the plurality of sub-data lines is disposed on both sides of the plurality of sub-pixels disposed on a column. Any one third sub-pixel of the plurality of third sub-pixels disposed on a row is connected to a sub-data line disposed on one side of the any one of third sub-pixel. Furthermore, another third sub-pixel adjacent to any one third sub-pixel among the plurality of third sub-pixels disposed on the row is connected to a sub-data line disposed on the other side of the adjacent third sub-pixel. Thus, it is possible to remove line dim.

The plurality of sub-pixels may be disposed in a matrix form on a (4l-3)th row to a 4lth row and on a (8k-7)th column to an 8kth column (herein, each of l and k may be a natural number of 1 or more), and the first sub-pixels may be red sub-pixels, the second sub-pixels may be white sub-pixels, and the third sub-pixels may be blue sub-pixels.

The plurality of data lines may include a first data line configured to apply a data voltage to the first sub-pixels and the second sub-pixels disposed on the (8k-7)th column; a second data line configured to apply a data voltage to the third sub-pixels disposed on a (8k-6)th column, a third data line configured to apply a data voltage to the first sub-pixels and the second sub-pixels disposed on a (8k-5)th column, a fourth data line configured to apply a data voltage to the third sub-pixels disposed on a (8k-4)th column, a fifth data line configured to apply a data voltage to the first sub-pixels and the second sub-pixels disposed on a (8k-3)th column, a sixth data line configured to apply a data voltage to the third sub-pixels disposed on a (8k-2)th column, a seventh data line configured to apply a data voltage to the first sub-pixels and the second sub-pixels disposed on a (8k-1)th column; and an eighth data line configured to apply a data voltage to the third sub-pixels disposed on the 8kth column.

The first data line may branch into a (1-1)th sub-data line disposed on one side of the first sub-pixels and the second sub-pixels disposed on the (8k-7)th column, and a (1-2)th sub-data line disposed on the other side of the first sub-pixels and the second sub-pixels disposed on the (8k-7)th column, and the second data line may branch into a (2-1)th sub-data line disposed on one side of the third sub-pixels disposed on the (8k-6)th column, and a (2-2)th sub-data line disposed on the other side of the third sub-pixels disposed on the (8k-6)th column, and the third data line may branch into a (3-1)th sub-data line disposed on one side of the first sub-pixels and the second sub-pixels disposed on the (8k-5)th column, and a (3-2)th sub-data line disposed on the other side of the first sub-pixels and the second sub-pixels disposed on the (8k-5)th column, and the fourth data line may branch into a (4-1)th sub-data line disposed on one side of the third sub-pixels disposed on the (8k-4)th column, and a (4-2)th sub-data line disposed on the other side of the third sub-pixels disposed on the (8k-4)th column, and the fifth data line may branch into a (5-1)th sub-data line disposed on one side of the first sub-pixels and the second sub-pixels disposed on the (8k-3)th column, and a (5-2)th sub-data line disposed on the other side of the first sub-pixels and the second sub-pixels disposed on the (8k-3)th column, and the sixth data line may branch into a (6-1)th sub-data line disposed on one side of the third sub-pixels disposed on the (8k-2)th column, and a (6-2)th sub-data line disposed on the other side of the third sub-pixels disposed on the (8k-2)th column, and the seventh data line may branch into a (7-1)th sub-data line disposed on one side of the first sub-pixels and the second sub-pixels disposed on the (8k-1)th column, and a (7-2)th sub-data line disposed on the other side of the first sub-pixels and the second sub-pixels disposed on the (8k-1)th column, and the eighth data line may branch into a (8-1)th sub-data line disposed on one side of the third sub-pixels disposed on the 8kth column, and a (8-2)th sub-data line disposed on the other side of the third sub-pixels disposed on the 8kth column.

The (2-1)th sub-data line may be connected to a third sub-pixel disposed on a (4l-2)th row and the (8k-6)th column and a third sub-pixel disposed on the 4lth row and the (8k-6)th column, and the (2-2)th sub-data line may be connected to a third sub-pixel disposed on the (4l-3)th row and the (8k-6)th column and a third sub-pixel disposed on a (4l-1)th row and the (8k-6)th column, and the (4-1)th sub-data line may be connected to a third sub-pixel disposed on the (4l-3)th row and the (8k-4)th column and a third sub-pixel disposed on the (4l-1)th row and the (8k-4)th column, and the (4-2)th sub-data line may be connected to a third sub-pixel disposed on the (4l-2)th row and the (8k-4)th column and a third sub-pixel disposed on the 4lth row and the (8k-4)th column, and the (6-1)th sub-data line may be connected to a third sub-pixel disposed on the (4l-2)th row and the (8k-2)th column and a third sub-pixel disposed on the 4lth row and the (8k-2)th column, and the (6-2)th sub-data line may be connected to a third sub-pixel disposed on the (4l-3)th row and the (8k-2)th column and a third sub-pixel disposed on the (4l-1)th row and the (8k-2)th column, and the (8-1)th sub-data line may be connected to a third sub-pixel disposed on the (4l-3)th row and the 8kth column and a third sub-pixel disposed on the (4l-1)th row and the 8kth column, and the (8-2)th sub-data line may be connected to a third sub-pixel disposed on the (4l-2)th row and the 8kth column and a third sub-pixel disposed on the 4lth row and the 8kth column.

The (1-1)th sub-data line may be connected to a first sub-pixel disposed on the (4l-3)th row and the (8k-7)th column and a first sub-pixel disposed on the (4l-1)th row and the (8k-7)th column, and the (1-2)th sub-data line may be connected to a second sub-pixel disposed on the (4l-2)th row and the (8k-7)th column and a second sub-pixel disposed on the 4lth row and the (8k-7)th column, and the (3-1)th sub-data line may be connected to a second sub-pixel disposed on the (4l-3)th row and the (8k-5)th column and a second sub-pixel disposed on the (4l-1)th row and the (8k-5)th column, and the (3-2)th sub-data line may be connected to a first sub-pixel disposed on the (4l-2)th row and the (8k-5)th column and a first sub-pixel disposed on the 4lth row and the (8k-5)th column, and the (5-1)th sub-data line may be connected to a first sub-pixel disposed on the (4l-3)th row and the (8k-3)th column and a first sub-pixel disposed on the (4l-1)th row and the (8k-3)th column, and the (5-2)th sub-data line may be connected to a second sub-pixel disposed on the (4l-2)th row and the (8k-3)th column and a second sub-pixel disposed on the 4lth row and the (8k-3)th column, and the (7-1)th sub-data line may be connected to a second sub-pixel disposed on the (4l-3)th row and the (8k-1)th column and a second sub-pixel disposed on the (4l-1)th row and the (8k-1)th column, and the (7-2)th sub-data line may be connected to a first sub-pixel disposed on the (4l-2)th row and the (8k-1)th column and a first sub-pixel disposed on the 4lth row and the (8k-1)th column.

The (2-1)th sub-data line may be connected to a third sub-pixel disposed on a (4l-2)th row and the (8k-6)th column and a third sub-pixel disposed on a (4l-1)th row and the (8k-6)th column, and the (2-2)th sub-data line may be connected to a third sub-pixel disposed on the (4l-3)th row and the (8k-6)th column and a third sub-pixel disposed on the 4lth row and the (8k-6)th column, and the (4-1)th sub-data line may be connected to a third sub-pixel disposed on the (4l-3)th row and the (8k-4)th column and a third sub-pixel disposed on the 4lth row and the (8k-4)th column, and the (4-2)th sub-data line may be connected to a third sub-pixel disposed on the (4l-2)th row and the (8k-4)th column and a third sub-pixel disposed on the (4l-1)th row and the (8k-4)th column, and the (6-1)th sub-data line may be connected to a third sub-pixel disposed on the (4l-2)th row and the (8k-2)th column and a third sub-pixel disposed on the (4l-1)th row and the (8k-2)th column, and the (6-2)th sub-data line may be connected to a third sub-pixel disposed on the (4l-3)th row and the (8k-2)th column and a third sub-pixel disposed on the 4lth row and the (8k-2)th column, and the (8-1)th sub-data line may be connected to a third sub-pixel disposed on the (4l-3)th row and the 8kth column and a third sub-pixel disposed on the 4lth row and the 8kth column, and the (8-2)th sub-data line may be connected to a third sub-pixel disposed on the (4l-2)th row and the 8kth column and a third sub-pixel disposed on the (4l-1)th row and the 8kth column.

The (1-1)th sub-data line may be connected to a first sub-pixel disposed on the (4l-3)th row and the (8k-7)th column and a second sub-pixel disposed on the 4lth row and the (8k-7)th column, and the (1-2)th sub-data line may be connected to a second sub-pixel disposed on a (4l-2)th row and the (8k-7)th column and a first sub-pixel disposed on a (4l-1)th row and the (8k-7)th column, and the (3-1)th sub-data line may be connected to a second sub-pixel disposed on the (4l-3)th row and the (8k-5)th column and a first sub-pixel disposed on the 4lth row and the (8k-5)th column, and the (3-2)th sub-data line may be connected to a first sub-pixel disposed on the (4l-2)th row and the (8k-5)th column and a second sub-pixel disposed on the (4l-1)th row and the (8k-5)th column, and the (5-1)th sub-data line may be connected to a second sub-pixel disposed on the (4l-2)th row and the (8k-3)th column and a first sub-pixel disposed on the (4l-1)th row and the (8k-3)th column, and the (5-2)th sub-data line may be connected to a first sub-pixel disposed on the (4l-3)th row and the (8k-3)th column and a second sub-pixel disposed on the 4lth row and the (8k-3)th column, and the (7-1)th sub-data line may be connected to a first sub-pixel disposed on the (4l-2)th row and the (8k-1)th column and a second sub-pixel disposed on the (4l-1)th row and the (8k-1)th column, and the (7-2)th sub-data line may be connected to a second sub-pixel disposed on the (4l-3)th row and the (8k-1)th column and a first sub-pixel disposed on the 4lth row and the (8k-1)th column.

A (1-1)th switching element connected to the first data line and the (1-1)th sub-data line; a (1-2)th switching element connected to the first data line and the (1-2)th sub-data line, a (2-1)th switching element connected to the second data line and the (2-1)th sub-data line, a (2-2)th switching element connected to the second data line and the (2-2)th sub-data line, a (3-1)th switching element connected to the third data line and the (3-1)th sub-data line, a (3-2)th switching element connected to the third data line and the (3-2)th sub-data line, a (4-1)th switching element connected to the fourth data line and the (4-1)th sub-data line, a (4-2)th switching element connected to the fourth data line and the (4-2)th sub-data line, a (5-1)th switching element connected to the fifth data line and the (5-1)th sub-data line, a (5-2)th switching element connected to the fifth data line and the (5-2)th sub-data line, a (6-1)th switching element connected to the sixth data line and the (6-1)th sub-data line, a (6-2)th switching element connected to the sixth data line and the (6-2)th sub-data line, a (7-1)th switching element connected to the seventh data line and the (7-1)th sub-data line, a (7-2)th switching element connected to the seventh data line and the (7-2)th sub-data line, a (8-1)th switching element connected to the eighth data line and the (8-1)th sub-data line; and a (8-2)th switching element connected to the eighth data line and the (8-2)th sub-data line.

The (1-1)th switching element, the (2-2)th switching element, the (3-1)th switching element, the (4-1)th switching element, the (5-1)th switching element, the (6-2)th switching element, the (7-1)th switching element and the (8-1)th switching element may be controlled by a first enable signal, and the (1-2)th switching element, the (2-1)th switching element, the (3-2)th switching element, the (4-2)th switching element, the (5-2)th switching element, the (6-1)th switching element, the (7-2)th switching element and the (8-2)th switching element may be controlled by a second enable signal, and the first enable signal may be a square wave inverted every horizontal period, and the second enable signal may be a square wave whose phase may be inverted with respect to the first enable signal.

The (1-1)th switching element, the (2-2)th switching element, the (3-1)th switching element, the (4-1)th switching element, the (5-2)th switching element, the (6-2)th switching element, the (7-2)th switching element and the (8-1)th switching element may be controlled by a first enable signal, and the (1-2)th switching element, the (2-1)th switching element, the (3-2)th switching element, the (4-2)th switching element, the (5-1)th switching element, the (6-1)th switching element, the (7-1)th switching element and the (8-2)th switching element may be controlled by a second enable signal, and the first enable signal may be a square wave inverted every horizontal period, and the second enable signal may be a square wave whose phase may be inverted with respect to the first enable signal.

The plurality of scan lines may include a first scan line configured to apply a first scan voltage to a plurality of sub-pixels disposed on the (4l-3)th row, a second scan line configured to apply a second scan voltage to a plurality of sub-pixels disposed on a (4l-2)th row, a third scan line configured to apply a third scan voltage to a plurality of sub-pixels disposed on a (4l-1)th row; and a fourth scan line configured to apply a fourth scan voltage to a plurality of sub-pixels disposed on the 4lth row.

When the first scan voltage may be output at a turn-on level in a first horizontal period and a second horizontal period, and the second scan voltage may be output at the turn-on level in the second horizontal period and a third horizontal period, and the third scan voltage may be output at the turn-on level in the third horizontal period and a fourth horizontal period, and the fourth scan voltage may be output at the turn-on level in the fourth horizontal period and a fifth horizontal period, and the first horizontal period, the second horizontal period, the third horizontal period, the fourth horizontal period and the fifth horizontal period may be consecutive.

The first scan voltage may be output at a turn-on level in a first horizontal period and a second horizontal period, and the second scan voltage may be output at the turn-on level in the second horizontal period and a third horizontal period, and the fourth scan voltage may be output at the turn-on level in the third horizontal period and a fourth horizontal period, and the third scan voltage may be output at the turn-on level in the fourth horizontal period and a fifth horizontal period, and the first horizontal period, the second horizontal period, the third horizontal period, the fourth horizontal period and the fifth horizontal period may be consecutive.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. Therefore, it should be understood that the above-described exemplary embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A display device, comprising:

a display panel in which a plurality of sub-pixels are repeatedly disposed in a matrix form;

a data driver configured to supply a data voltage to the plurality of sub-pixels via a plurality of data lines; and a gate driver configured to supply a scan signal to the plurality of sub-pixels via a plurality of scan lines, wherein the plurality of sub-pixels includes first sub-pixels, second sub-pixels, and third sub-pixels having different colors from each other, wherein the first sub-pixels and the second sub-pixels are alternately disposed on odd-numbered columns, wherein the third sub-pixels are disposed on even-numbered columns, each of the plurality of data lines branches into a plurality of sub-data lines through a multiplexor (MUX), the plurality of sub-data lines are disposed on both sides of the plurality of sub-pixels disposed on a column, any one third sub-pixel of the plurality of third sub-pixels disposed on a row is connected to a sub-data line from the plurality of sub-data lines, the sub-data line disposed on one side of the third sub-pixel, and another third sub-pixel adjacent to any one third sub-pixel among the plurality of third sub-pixels disposed on the row is connected to another sub-data line from the plurality of sub-data line, the other sub-data line disposed on another side of the another third sub-pixel, wherein the multiplexor includes a plurality of switching elements, each of the plurality of switching elements connects each of the plurality of data lines to any one of the plurality of sub-data lines branching from each of the plurality of data lines depending on a first enable signal and a second enable signal, wherein the plurality of sub-pixels are disposed in a matrix form on a (4l-3)th row to a 4lth row and on a (8k-7)th column to a 8kth column where each of l and k is a natural number of 1 or more, and wherein the first sub-pixels are red sub-pixels, the second sub-pixels are blue sub-pixels, and the third sub-pixels are green sub-pixels.

2. The display device according to claim 1, wherein the plurality of data lines includes:

a first data line configured to apply a data voltage to the first sub-pixels and the second sub-pixels disposed on the (8k-7)th column;

a second data line configured to apply a data voltage to the third sub-pixels disposed on a (8k-6)th column, a third data line configured to apply a data voltage to the first sub-pixels and the second sub-pixels disposed on a (8k-5)th column, a fourth data line configured to apply a data voltage to the third sub-pixels disposed on a (8k-4)th column, a fifth data line configured to apply a data voltage to the first sub-pixels and the second sub-pixels disposed on a (8k-3)th column, a sixth data line configured to apply a data voltage to the third sub-pixels disposed on a (8k-2)th column, a seventh data line configured to apply a data voltage to the first sub-pixels and the second sub-pixels disposed on a (8k-1)th column; and an eighth data line configured to apply a data voltage to the third sub-pixels disposed on the 8kth column.

3. The display device according to claim 2, wherein the first data line branches into a (1-1)th sub-data line disposed on one side of the first sub-pixels and the second sub-pixels disposed on the (8k-7)th column, and a (1-2)th sub-data line disposed on another side of the first sub-pixels and the second sub-pixels disposed on the (8k-7)th column, and the second data line branches into a (2-1)th sub-data line disposed on one side of the third sub-pixels disposed on the (8k-6)th column, and a (2-2)th sub-data line disposed on another side of the third sub-pixels disposed on the (8k-6)th column, and the third data line branches into a (3-1)th sub-data line disposed on one side of the first sub-pixels and the second sub-pixels disposed on the (8k-5)th column, and a (3-2)th sub-data line disposed on another side of the first sub-pixels and the second sub-pixels disposed on the (8k-5)th column, and the fourth data line branches into a (4-1)th sub-data line disposed on one side of the third sub-pixels disposed on the (8k-4)th column, and a (4-2)th sub-data line disposed on another side of the third sub-pixels disposed on the (8k-4)th column, and the fifth data line branches into a (5-1)th sub-data line disposed on one side of the first sub-pixels and the second sub-pixels disposed on the (8k-3)th column, and a (5-2)th sub-data line disposed on another side of the first sub-pixels and the second sub-pixels disposed on the (8k-3)th column, and the sixth data line branches into a (6-1)th sub-data line disposed on one side of the third sub-pixels disposed on the (8k-2)th column, and a (6-2)th sub-data line disposed on another side of the third sub-pixels disposed on the (8k-2)th column, and the seventh data line branches into a (7-1)th sub-data line disposed on one side of the first sub-pixels and the second sub-pixels disposed on the (8k-1)th column, and a (7-2)th sub-data line disposed on another side of the first sub-pixels and the second sub-pixels disposed on the (8k-1)th column, and the eighth data line branches into a (8-1)th sub-data line disposed on one side of the third sub-pixels disposed on the 8kth column, and a (8-2)th sub-data line disposed on another side of the third sub-pixels disposed on the 8kth column.

4. The display device according to claim 3, wherein the (2-1)th sub-data line is connected to a third sub-pixel disposed on a (4l-2)th row and the (8k-6)th column and a third sub-pixel disposed on the 4lth row and the (8k-6)th column, and the (2-2)th sub-data line is connected to a third sub-pixel disposed on the (4l-3)th row and the (8k-6)th column and a third sub-pixel disposed on a (4l-1)th row and the (8k-6)th column, and the (4-1)th sub-data line is connected to a third sub-pixel disposed on the (4l-3)th row and the (8k-4)th column and a third sub-pixel disposed on the (4l-1)th row and the (8k-4)th column, and the (4-2)th sub-data line is connected to a third sub-pixel disposed on the (4l-2)th row and the (8k-4)th column and a third sub-pixel disposed on the 4lth row and the (8k-4)th column, and the (6-1)th sub-data line is connected to a third sub-pixel disposed on the (4l-2)th row and the (8k-2)th column and a third sub-pixel disposed on the 4lth row and the (8k-2)th column, and the (6-2)th sub-data line is connected to a third sub-pixel disposed on the (4l-3)th row and the (8k-2)th column and a third sub-pixel disposed on the (4l-1)th row and the (8k-2)th column, and the (8-1)th sub-data line is connected to a third sub-pixel disposed on the (4l-3)th row and the 8kth column and a third sub-pixel disposed on the (4l-1)th row and the 8kth column, and the (8-2)th sub-data line is connected to a third sub-pixel disposed on the (4l-2)th row and the 8kth column and a third sub-pixel disposed on the 4lth row and the 8kth column.

5. The display device according to claim 3, wherein the (1-1)th sub-data line is connected to a first sub-pixel disposed on the (4l-3)th row and the (8k-7)th column and a first sub-pixel disposed on the (4l-1)th row and the (8k-7)th column, and the (1-2)th sub-data line is connected to a second sub-pixel disposed on the (4l-2)th row and the (8k-7)th column and a second sub-pixel disposed on the 4lth row and the (8k-7)th column, and the (3-1)th sub-data line is connected to a second sub-pixel disposed on the (4l-3)th row and the (8k-5)th column and a second sub-pixel disposed on the (4l-1)th row and the (8k-5)th column, and the (3-2)th sub-data line is connected to a first sub-pixel disposed on the (4l-2)th row and the (8k-5)th column and a first sub-pixel disposed on the 4lth row and the (8k-5)th column, and the (5-1)th sub-data line is connected to a first sub-pixel disposed on the (4l-3)th row and the (8k-3)th column and a first sub-pixel disposed on the (4l-1)th row and the (8k-3)th column, and the (5-2)th sub-data line is connected to a second sub-pixel disposed on the (4l-2)th row and the (8k-3)th column and a second sub-pixel disposed on the 4lth row and the (8k-3)th column, and the (7-1)th sub-data line is connected to a second sub-pixel disposed on the (4l-3)th row and the (8k-1)th column and a second sub-pixel disposed on the (4l-1)th row and the (8k-1)th column, and the (7-2)th sub-data line is connected to a first sub-pixel disposed on the (4l-2)th row and the (8k-1)th column and a first sub-pixel disposed on the 4lth row and the (8k-1)th column.

6. The display device according to claim 3, wherein the (2-1)th sub-data line is connected to a third sub-pixel disposed on a (4l-2)th row and the (8k-6)th column and a third sub-pixel disposed on a (4l-1)th row and the (8k-6)th column, and the (2-2)th sub-data line is connected to a third sub-pixel disposed on the (4l-3)th row and the (8k-6)th column and a third sub-pixel disposed on the 4lth row and the (8k-6)th column, and the (4-1)th sub-data line is connected to a third sub-pixel disposed on the (4l-3)th row and the (8k-4)th column and a third sub-pixel disposed on the 4lth row and the (8k-4)th column, and the (4-2)th sub-data line is connected to a third sub-pixel disposed on the (4l-2)th row and the (8k-4)th column and a third sub-pixel disposed on the (4l-1)th row and the (8k-4)th column, and the (6-1)th sub-data line is connected to a third sub-pixel disposed on the (4l-2)th row and the (8k-2)th column and a third sub-pixel disposed on the (4l-1)th row and the (8k-2)th column, and the (6-2)th sub-data line is connected to a third sub-pixel disposed on the (4l-3)th row and the (8k-2)th column and a third sub-pixel disposed on the 4lth row and the (8k-2)th column, and the (8-1)th sub-data line is connected to a third sub-pixel disposed on the (4l-3)th row and the 8kth column and a third sub-pixel disposed on the 4lth row and the 8kth column, and the (8-2)th sub-data line is connected to a third sub-pixel disposed on the (4l-2)th row and the 8kth column and a third sub-pixel disposed on the (4l-1)th row and the 8kth column.

7. The display device according to claim 3, wherein the (1-1)th sub-data line is connected to a first sub-pixel disposed on the (4l-3)th row and the (8k-7)th column and a second sub-pixel disposed on the 4lth row and the (8k-7)th column, and the (1-2)th sub-data line is connected to a second sub-pixel disposed on a (4l-2)th row and the (8k-7)th column and a first sub-pixel disposed on a (4l-1)th row and the (8k-7)th column, and the (3-1)th sub-data line is connected to a second sub-pixel disposed on the (4l-3)th row and the (8k-5)th column and a first sub-pixel disposed on the 4lth row and the (8k-5)th column, and the (3-2)th sub-data line is connected to a first sub-pixel disposed on the (4l-2)th row and the (8k-5)th column and a second sub-pixel disposed on the (4l-1)th row and the (8k-5)th column, and the (5-1)th sub-data line is connected to a second sub-pixel disposed on the (4l-2)th row and the (8k-3)th column and a first sub-pixel disposed on the (4l-1)th row and the (8k-3)th column, and the (5-2)th sub-data line is connected to a first sub-pixel disposed on the (4l-3)th row and the (8k-3)th column and a second sub-pixel disposed on the 4lth row and the (8k-3)th column, and the (7-1)th sub-data line is connected to a first sub-pixel disposed on the (4l-2)th row and the (8k-1)th column and a second sub-pixel disposed on the (4l-1)th row and the (8k-1)th column, and the (7-2)th sub-data line is connected to a second sub-pixel disposed on the (4l-3)th row and the (8k-1)th column and a first sub-pixel disposed on the 4lth row and the (8k-1)th column.

8. The display device according to claim 3, wherein the MUX includes:

a (1-1)th switching element connected to the first data line and the (1-1)th sub-data line;

a (1-2)th switching element connected to the first data line and the (1-2)th sub-data line, a (2-1)th switching element connected to the second data line and the (2-1)th sub-data line, a (2-2)th switching element connected to the second data line and the (2-2)th sub-data line, a (3-1)th switching element connected to the third data line and the (3-1)th sub-data line, a (3-2)th switching element connected to the third data line and the (3-2)th sub-data line, a (4-1)th switching element connected to the fourth data line and the (4-1)th sub-data line, a (4-2)th switching element connected to the fourth data line and the (4-2)th sub-data line, a (5-1)th switching element connected to the fifth data line and the (5-1)th sub-data line, a (5-2)th switching element connected to the fifth data line and the (5-2)th sub-data line, a (6-1)th switching element connected to the sixth data line and the (6-1)th sub-data line, a (6-2)th switching element connected to the sixth data line and the (6-2)th sub-data line, a (7-1)th switching element connected to the seventh data line and the (7-1)th sub-data line, a (7-2)th switching element connected to the seventh data line and the (7-2)th sub-data line, a (8-1)th switching element connected to the eighth data line and the (8-1)th sub-data line; and a (8-2)th switching element connected to the eighth data line and the (8-2)th sub-data line.

9. The display device according to claim 8, wherein the (1-1)th switching element, the (2-2)th switching element, the (3-1)th switching element, the (4-1)th switching element, the (5-1)th switching element, the (6-2)th switching element, the (7-1)th switching element and the (8-1)th switching element are controlled by a first enable signal, wherein the (1-2)th switching element, the (2-1)th switching element, the (3-2)th switching element, the (4-2)th switching element, the (5-2)th switching element, the (6-1)th switching element, the (7-2)th switching element and the (8-2)th switching element are controlled by a second enable signal, and wherein the first enable signal is a square wave inverted every horizontal period, and the second enable signal is a square wave whose phase is inverted with respect to the first enable signal.

10. The display device according to claim 8, wherein the (1-1)th switching element, the (2-2)th switching element, the (3-1)th switching element, the (4-1)th switching element, the (5-2)th switching element, the (6-2)th switching element, the (7-2)th switching element and the (8-1)th switching element are controlled by a first enable signal, wherein the (1-2)th switching element, the (2-1)th switching element, the (3-2)th switching element, the (4-2)th switching element, the (5-1)th switching element, the (6-1)th switching element, the (7-1)th switching element and the (8-2)th switching element are controlled by a second enable signal, and wherein the first enable signal is a square wave inverted every horizontal period, and the second enable signal is a square wave whose phase is inverted with respect to the first enable signal.

11. The display device according to claim 1, wherein the plurality of scan lines includes:

a first scan line configured to apply a first scan voltage to a plurality of sub-pixels disposed on the (4l-3)th row;

a second scan line configured to apply a second scan voltage to a plurality of sub-pixels disposed on a (4l-2)th row;

a third scan line configured to apply a third scan voltage to a plurality of sub-pixels disposed on a (4l-1)th row; and a fourth scan line configured to apply a fourth scan voltage to a plurality of sub-pixels disposed on the 4lth row.

12. The display device according to claim 11, wherein the first scan voltage is output at a turn-on level in a first horizontal period and a second horizontal period, and the second scan voltage is output at the turn-on level in the second horizontal period and a third horizontal period, and the third scan voltage is output at the turn-on level in the third horizontal period and a fourth horizontal period, and the fourth scan voltage is output at the turn-on level in the fourth horizontal period and a fifth horizontal period, and the first horizontal period, the second horizontal period, the third horizontal period, the fourth horizontal period and the fifth horizontal period are consecutive.

13. The display device according to claim 11, wherein the first scan voltage is output at a turn-on level in a first horizontal period and a second horizontal period, and the second scan voltage is output at the turn-on level in the second horizontal period and a third horizontal period, and the fourth scan voltage is output at the turn-on level in the third horizontal period and a fourth horizontal period, and the third scan voltage is output at the turn-on level in the fourth horizontal period and a fifth horizontal period, and the first horizontal period, the second horizontal period, the third horizontal period, the fourth horizontal period and the fifth horizontal period are consecutive.

* * * * *